US009770116B2

(12) United States Patent
Conway et al.

(10) Patent No.: US 9,770,116 B2
(45) Date of Patent: Sep. 26, 2017

(54) CLIP ASSEMBLY FOR USE HOLDING SINUOUS SPRINGS

(71) Applicant: L&P Property Management Company, South Gate, CA (US)

(72) Inventors: Lawrence J. Conway, Des Plaines, IL (US); Scott A. Bridges, Lake Villa, IL (US)

(73) Assignee: L&P Property Management Company, South Gate, CA (US)

( * ) Notice: Subject to any disclaimer, the term of this patent is extended or adjusted under 35 U.S.C. 154(b) by 0 days.

(21) Appl. No.: 15/205,662

(22) Filed: Jul. 8, 2016

(65) Prior Publication Data

US 2016/0316930 A1 Nov. 3, 2016

Related U.S. Application Data

(60) Division of application No. 14/501,696, filed on Sep. 30, 2014, now Pat. No. 9,427,094, which is a continuation-in-part of application No. 13/648,611, filed on Oct. 10, 2012, now Pat. No. 8,991,016.

(51) Int. Cl.

| | |
|---|---|
| ***A47C 31/06*** | (2006.01) |
| ***A47C 23/16*** | (2006.01) |
| ***A47C 23/26*** | (2006.01) |
| *A47C 31/04* | (2006.01) |
| *A47C 23/057* | (2006.01) |

(52) U.S. Cl.

CPC ..... *A47C 31/06* (2013.01); *A47C 23/16* (2013.01); *A47C 23/26* (2013.01); *A47C 23/057* (2013.01); *A47C 31/04* (2013.01); *Y10T 24/3455* (2015.01); *Y10T 24/3476* (2015.01)

(58) Field of Classification Search

CPC ..... A47C 31/06; A47C 23/16; A47C 23/26; A47C 23/057; A47C 31/04; Y10T 24/3455; Y10T 24/3476

See application file for complete search history.

(56) References Cited

U.S. PATENT DOCUMENTS

| | | | |
|---|---|---|---|
| 2,111,404 | A | 3/1938 | Pankonin |
| 2,526,902 | A | 10/1950 | Rublee |
| 2,574,811 | A | 11/1951 | Blumensaadt |
| 3,083,369 | A | 4/1963 | Peterson |
| 3,252,569 | A | 5/1966 | Matthews |
| 3,263,294 | A | 8/1966 | Pappas |
| 3,323,183 | A | 6/1967 | Sterner |
| 3,422,468 | A | 1/1969 | Schutz |
| 3,553,794 | A | 1/1971 | Kneidl et al. |

(Continued)

FOREIGN PATENT DOCUMENTS

| | | |
|---|---|---|
| DE | 2250375 | 7/1973 |
| WO | 9743192 | 11/1997 |

*Primary Examiner* — Robert J Sandy
*Assistant Examiner* — Michael Lee
(74) *Attorney, Agent, or Firm* — Wood, Herron & Evans, LLP

(57) ABSTRACT

A piece of furniture includes a rectangular frame for supporting a plurality of sinuous springs. A plurality of clip assemblies are secured to opposed side walls of frame. Each clip assembly comprises a metallic piece having a generally planar portion and tacks for insertion into the frame. The generally planar portion of the metallic piece is encased by plastic of a non-metallic piece having a hook to secure one end of a sinuous wire. Flexible connectors may be located in grooves of the clip assembly to collate multiple clip assemblies.

21 Claims, 34 Drawing Sheets

(56) References Cited

U.S. PATENT DOCUMENTS

| | | | |
|---|---|---|---|
| 3,613,878 | A | 10/1971 | Langas et al. |
| 3,711,931 | A | 1/1973 | Ladouceur et al. |
| 3,722,670 | A | 3/1973 | Plunkett |
| 3,845,860 | A | 11/1974 | Ladouceur et al. |
| 3,874,263 | A | 4/1975 | Barth et al. |
| 3,940,844 | A | 3/1976 | Colby et al. |
| 3,992,853 | A | 11/1976 | Morris |
| 4,129,059 | A | 12/1978 | Van Eck |
| 4,153,959 | A | 5/1979 | Omley |
| 4,508,220 | A | 4/1985 | Pearson |
| 4,935,998 | A | 6/1990 | Frazier et al. |
| 4,955,813 | A | 9/1990 | Fochler |
| D330,851 | S | 11/1992 | Roick |
| 5,303,821 | A | 4/1994 | Ayres |
| 5,314,065 | A | 5/1994 | Ayres et al. |
| 5,564,564 | A | 10/1996 | Poffenberger |
| 5,682,994 | A | 11/1997 | Poffenberger |
| 5,833,064 | A | 11/1998 | Ayres et al. |
| 5,878,880 | A | 3/1999 | Poffenberger |
| 5,927,491 | A | 7/1999 | Room et al. |
| 6,055,716 | A | 5/2000 | Ayres et al. |
| 6,126,126 | A | 10/2000 | McKiernan, Jr. |
| 6,704,974 | B2 | 3/2004 | Lackler |
| 7,882,948 | B2 | 2/2011 | West |
| 9,427,094 | B2 | 8/2016 | Conway et al. |
| 2003/0025256 | A1 | 2/2003 | Roick |
| 2014/0096346 | A1 | 4/2014 | Conway et al. |

CLIP ASSEMBLY FOR USE HOLDING SINUOUS SPRINGS

CROSS-REFERENCE TO RELATED APPLICATIONS

This application is a divisional of U.S. patent application Ser. No. 14/501,696, a continuation-in-part of U.S. patent application Ser. No. 13/648,611, each being fully incorporated by reference herein.

FIELD OF THE INVENTION

This invention relates generally to clip assemblies for use in the manufacture of furniture and, more particularly, for holding sinuous springs in position in furniture.

BACKGROUND OF THE INVENTION

In many industries, as, for example, in the mattress or bedding industry, it is common practice to secure two wires or rods, such as a spring element of a mattress, to a border wire with clips made from sheet metal. Such clips are generally in a U-shape having an arcuate crown portion and oppositely spaced leg portions depending from the crown portion. The two wires to be connected are placed between the leg portions of the clip and the leg portions pushed together by a clinching tool, thus securing or locking the two wires together.

Such a clinching tool typically includes a J-shaped jaw into which the leading clip of a stack of clips is indexed. The clinching tool has a blade which shears off the first clip from a stack of clips placed inside the clinching tool. U.S. Pat. No. 2,574,811 shows such a clinching tool.

In order to operate the clinching tool, it is necessary to place a plurality of clips inside the clinching tool in an orderly fashion. The clips must be similarly oriented and in an abutting relationship to one another, each clip abutting the two adjacent clips in an orderly fashion.

Clips must be interconnected to each other in a flexible manner so that the stack of clips can be wound into the clinching tool.

The clips must also be interconnected with sufficient strength so that they are able to withstand high tensile forces associated with winding and unwinding of the stack of clips upon a spool in the clinching machine. Accidental breakage of the connector connecting adjacent clips would be detrimental to the operation of the clinching machine.

One common way used to interconnect similar U-shaped sheet metal clips together is by means of non-metal, elongated flexible members made of plastic. Slots or grooves through the arcuate portion of each U-shaped clip are lined up, such that the non-metallic flexible members may be placed inside all of the grooves in order to connect the clips together in a flexible manner.

Several techniques have been developed to secure the non-metallic flexible connectors inside the slots of each clip. U.S. Pat. No. 5,303,821 discloses deforming the side edges of the arcuate crown portion of each clip inwardly so as to crimp the plastic connectors inside the grooves or slots on the arcuate top portions of the sheet metal U-shaped clips. U.S. Pat. Nos. 5,564,564; 5,682,994 and 5,878,880 each disclose a U-shaped clip having tabs extending upwardly from slots formed in the arcuate crown portion of the clip. After connectors are placed inside the slots of a plurality of aligned clips, a roller or rollers pass over the arcuate crown portions of the clips to push down the tabs of each clip, thereby securing the connectors inside the slots.

U.S. Pat. No. 5,878,880 discloses a clip made of sheet metal having a U-shaped hook portion inside which is secured a sheet of cushioning material, such as plastic. When a wire is placed inside the hook portion, the cushioning material prevents wire-on-wire noise, such as squeaking. U.S. Pat. No. 5,833,064 discloses another such clip having a plastic liner to prevent metal-on-metal squeaking or 'noise". Over time, these plastic liners may wear out or move/shift.

These two patents, U.S. Pat. Nos. 5,878,880 and 5,833,064, disclose U-shaped clips which may be connected to identical clips in a string and which have prongs or tacks inherently formed from the sheet metal, the prongs being bent downwardly and adapted to be inserted into wooden rails of furniture frames. These prongs or tacks have a smooth surface which may not hold the clip inside wooden rails of furniture frames as securely as desired.

Thus, there is a need for a clip assembly which may be made partially of metal and partially of plastic which does not result in squeaking or "noise" over time.

There is further a need for a clip assembly which may be constructed of less sheet metal than known clips, thereby reducing the cost of the clips.

There is further a need for a clip assembly which provides improved holding strength when inserted inside wooden rails of furniture frames.

SUMMARY OF THE INVENTION

This invention comprises a clip assembly for securing an end portion of a sinuous spring to a wooden rail. The clip assembly comprises two components: a plastic clip and a metal fastener, including at least two tacks extending downwardly from a portion of the metal fastener wherein each of the tacks passes through the plastic clip. The tacks may be driven through, molded into or passed through holes or openings in the plastic clip. The metal fastener is a unitary member, the tacks of the metal fastener being formed from the metal material of the fastener and extending outwardly from the remainder of the metal fastener. The tacks may be creased and/or serrated to ensure a sturdy, secure connection of the clip assembly to the wood of the furniture frame. In some embodiments, each metal fastener or second piece of each clip assembly may have two tacks. In other embodiments, each metal fastener or second piece of each clip assembly may have four tacks.

According to another aspect of this invention, the clip assembly comprises a non-metallic clip having a U-shaped hook portion adapted to receive and retain a portion of a spring and a metal fastener, including at least two tacks extending outwardly from a planar portion of the fastener wherein each of the tacks passes through the non-metallic clip. In any of the embodiments of this invention, the plastic clip may lack openings, in which case the tacks of the metal fastener would be driven through the material of the non-metallic clip.

According to another aspect of this invention, the clip assembly comprises a first non-metallic piece having openings therethrough and a second metal piece having projections extending through the openings of the first piece, the projections being adapted to be secured into a wooden rail.

DETAILED DESCRIPTION OF THE DRAWINGS

Figure 1:
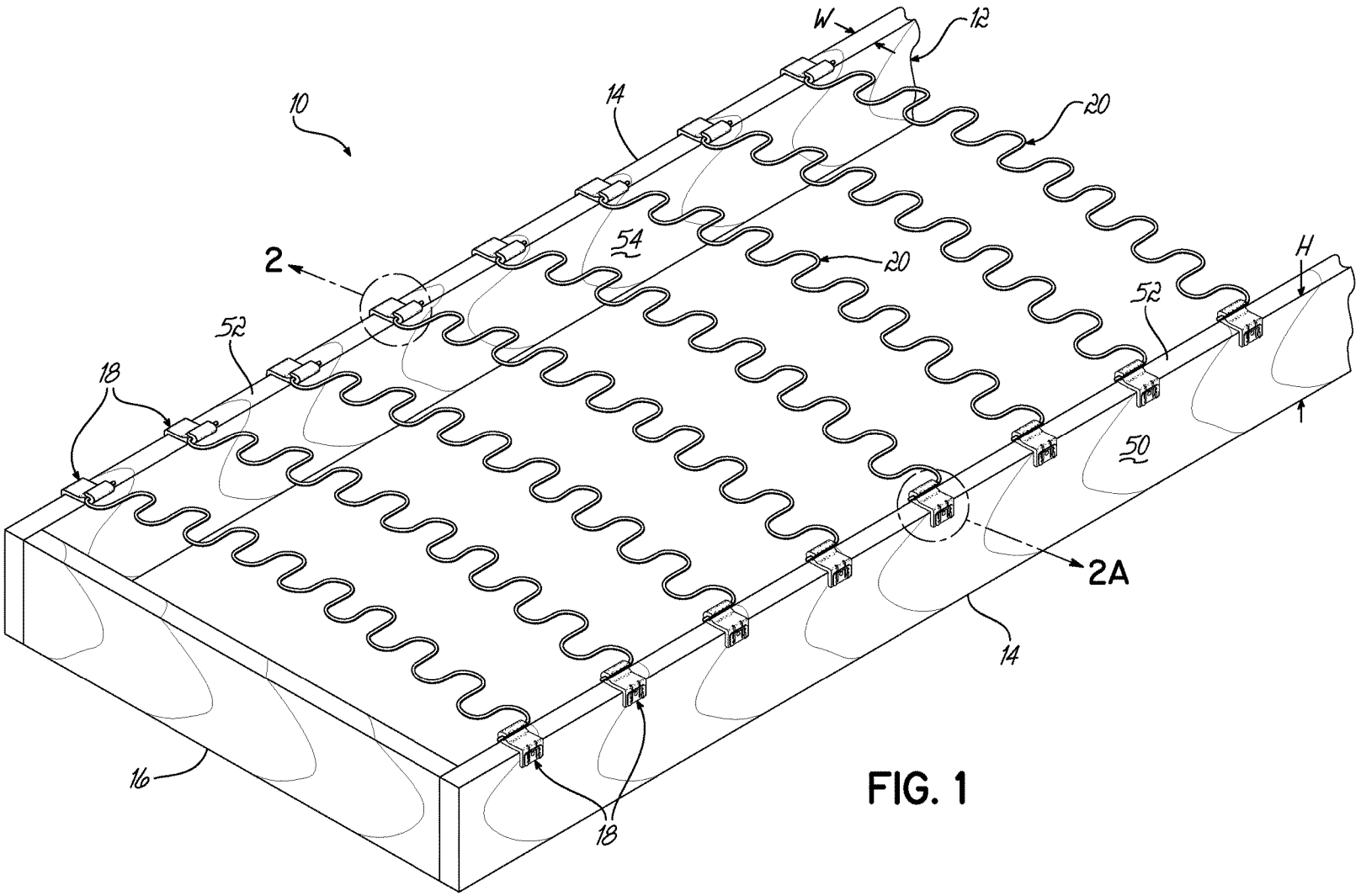
FIG. 1 is a perspective view of a furniture frame and sinuous springs extending from one side to the other side of the frame, clip assemblies in accordance with one embodiment being secured to the frame sides.

Referring to the drawings, and particularly to FIG. 1, there is illustrated a portion of a piece of furniture 10 comprising a rectangular frame 12 comprising two side walls 14 and two end walls 16 (only one being shown in FIG. 1). For purposes of this document, the word "furniture" is not intended to be limiting; it may include seats for vehicles or other frames. The frame 12 is most commonly made of wood, but may be made of other suitable materials. In the embodiment of frame 12 shown in FIG. 1, each of the side and end walls 14, 16, respectively, is placed on edge with the height "H" being greater than the width "W" of each wall.

As shown in FIG. 1, furniture piece 10 further comprises a plurality of clip assemblies 18 secured to the side walls 14 of the frame 12 in a spaced manner for securing and retaining a plurality of sinuous springs 20. Clip assemblies 18, secured to opposed side walls 14, are aligned to receive and retain end portions 21 of sinuous springs 20 in desired positions and under desired amounts of tension, as shown in FIG. 1. Commonly, such sinuous springs 20 are arched or bowed upwardly to provide resiliency to the furniture piece 10.

Figure 2A:
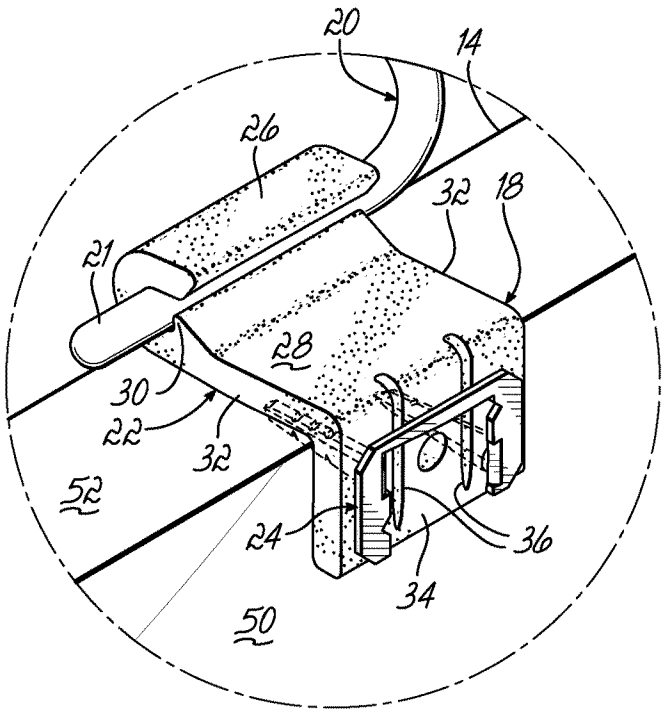
FIG. 2A is an enlarged view of the encircled area 2A of FIG. 1.
Figure 2:
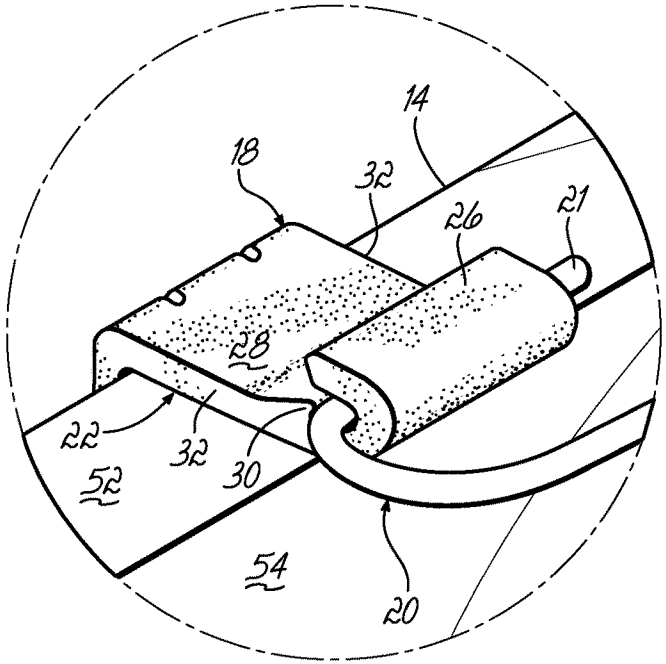
FIG. 2 is an enlarged view of the encircled area 2 of FIG. 1.
Figure 6B:
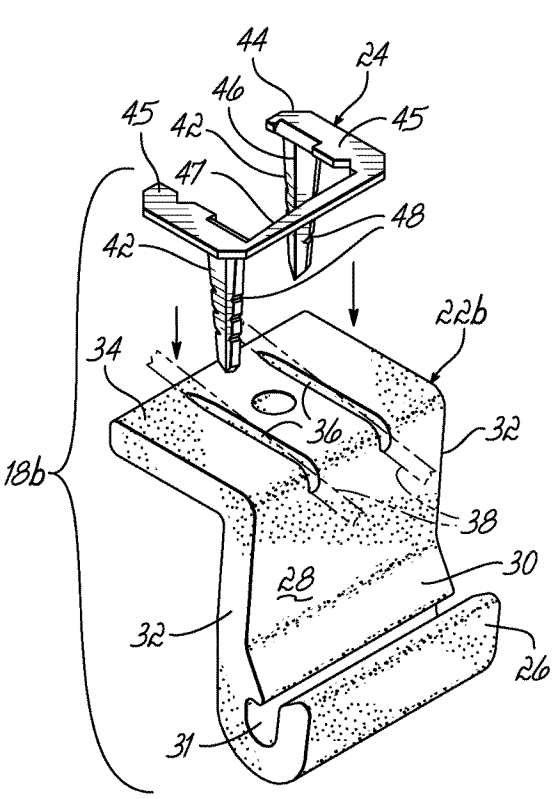
FIG. 6B is a partially disassembled view, similar to FIG. 6, of a portion of an alternative embodiment of clip assembly.

FIGS. 2 and 2A each show one of the clip assemblies 18 secured to one of the side walls 14 of frame 12. As best shown in FIG. 6, each clip assembly 18 comprises a first non-metallic piece or clip 22, usually made of plastic, and a second metal piece or fastener 24, respectively. The pieces 22, 24 are joined together and secured to one of the side walls 14 of the generally rectangular furniture frame 12.

Figure 3:
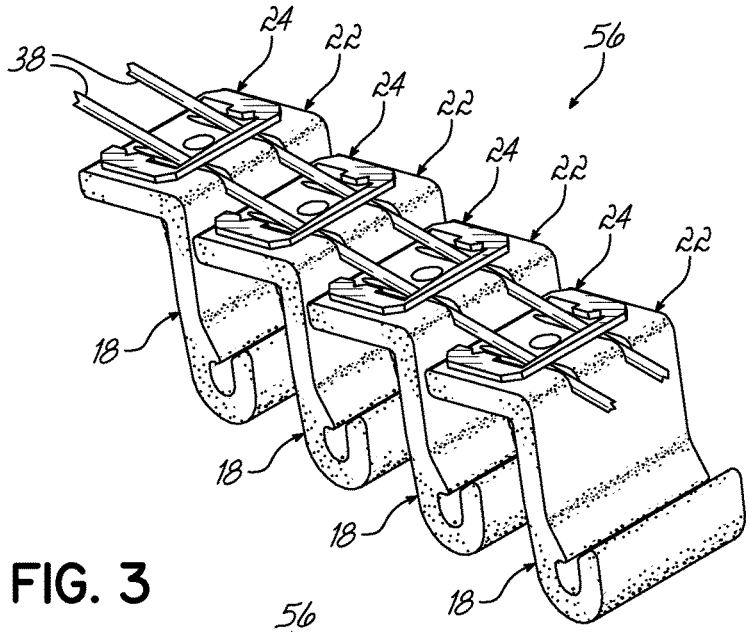
FIG. 3 is a perspective view of a portion of a collated string of clip assemblies of FIG. 1.
Figure 4:
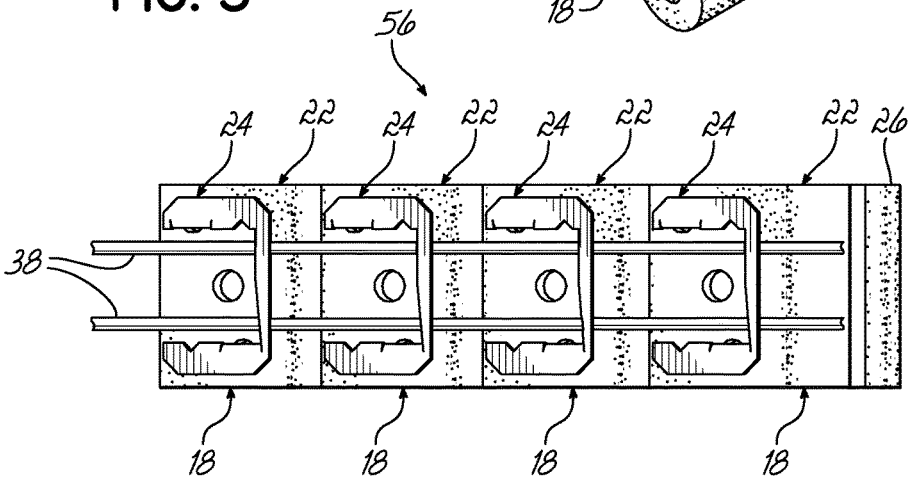
FIG. 4 is a top plan view of the portion of the collated string of clip assemblies of FIG. 3.
Figure 5:
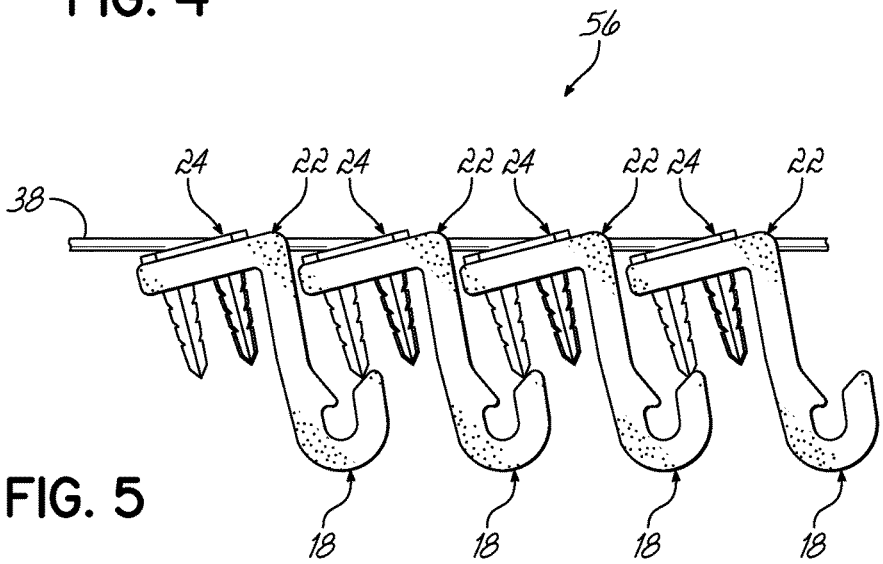
FIG. 5 is a side elevational view of the portion of the collated string of clip assemblies of FIG. 3.

The first piece 22 of clip assembly 18 comprises a U-shaped hook portion 26 adapted to receive and retain an end portion 21 of one of the sinuous springs 20. The first piece 18 further comprises a generally planar body portion 28 which includes a ledge 30 extending from one side edge 32 to the opposed side edge 32 of the body portion 28 of the first piece 22 of the clip assembly 18. When the end portion 21 of one of the sinuous springs 20 is inserted into the U-shaped hook portion 26, the ledge 30 of the body portion 28 holds or retains the end portion 21 of the sinuous spring 20 in a receptacle 31, illustrated in FIG. 8. The first piece 22 of clip assembly 18 further comprises a generally planar flange portion 34 extending outwardly from the end of the body portion 28 opposite the U-shaped hook portion 26 in a direction generally orthogonal or perpendicular to the body portion 28. As best shown in FIG. 2A, the flange portion 34 of the first piece 22 of clip assembly 18 has a pair of spaced grooves 36 adapted to receive non-metallic connectors 38 which connect multiple clip assemblies 18 together, as shown in FIGS. 3-5. In some embodiments, the grooves 36 may be omitted. For example, clip assemblies shown in FIG. 6 may lack grooves 36.

As shown in FIG. 6, the flange portion 34 of the first piece 22 of clip assembly 18 has a pair of spaced openings 40, each opening 40 extending through the thickness of the flange portion 34 of the first piece 22 of clip assembly 18. Although the openings 40 are shown as being round holes, they may be any other shapes, such as rectangular, for example.

Figure 8:
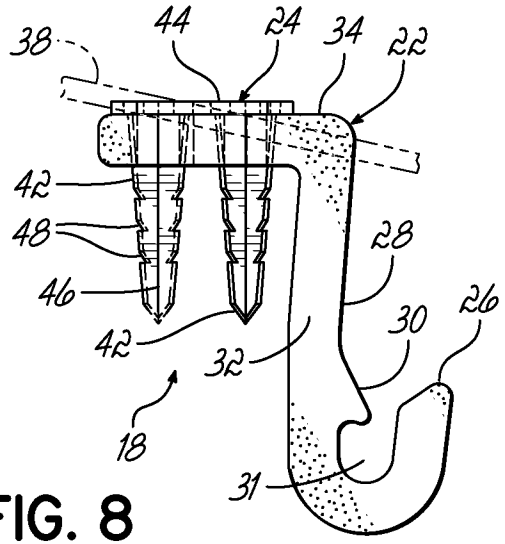
FIG. 8 is a side elevational view of the clip assembly of FIG. 6.
Figure 7:
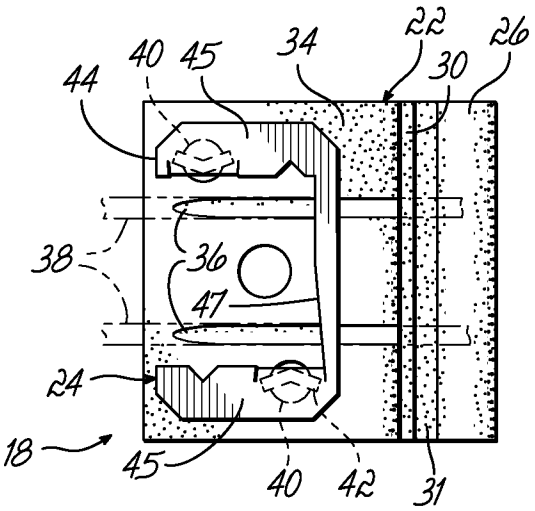
FIG. 7 is a top plan view of the clip assembly of FIG. 6.

As best shown in FIG. 6, the second piece 24 of clip assembly 18 has a pair of tacks 42 extending downwardly from a generally planar, generally U-shaped body portion 44 of the second piece 24 of clip assembly 18. More particularly, each of the tacks 42 extends downwardly from one of the sides 45 of the generally U-shaped body portion 44 of the second piece 24 of clip assembly 18. The sides 45 of the generally U-shaped body portion 44 of the second piece 24 of clip assembly 18 are connected by a connecting portion 47. The tacks 42 of the second piece 24 of clip assembly 18 are located and sized to pass through the openings 40 of the first piece 22 of clip assembly 18. Each of the tacks 42 of the second piece 24 of clip assembly 18 has a crease 46 therein so the tack 42 has a non-planar cross-section. More particularly, the cross-section of each tack 42 has a generally "V-shape", as shown in FIG. 5. As best shown in FIG. 8, each of the tacks 42 of the second piece 24 of clip assembly 18 also has a plurality of vertically spaced serrations or indentations 48 to improve the holding strength of the clip assembly 18 to the wooden furniture frame 12.

Figure 6A:
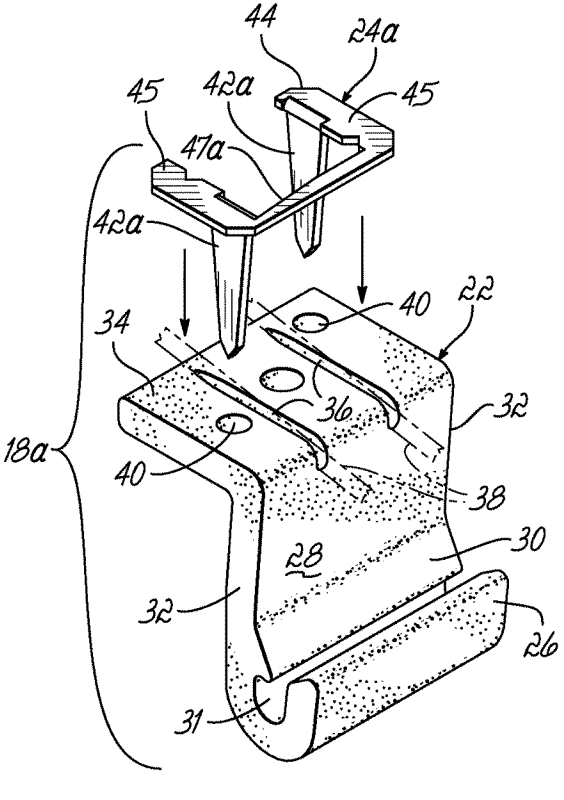
FIG. 6A is a partially disassembled view, similar to FIG. 6, of a portion of an alternative embodiment of clip assembly.
Figure 6:
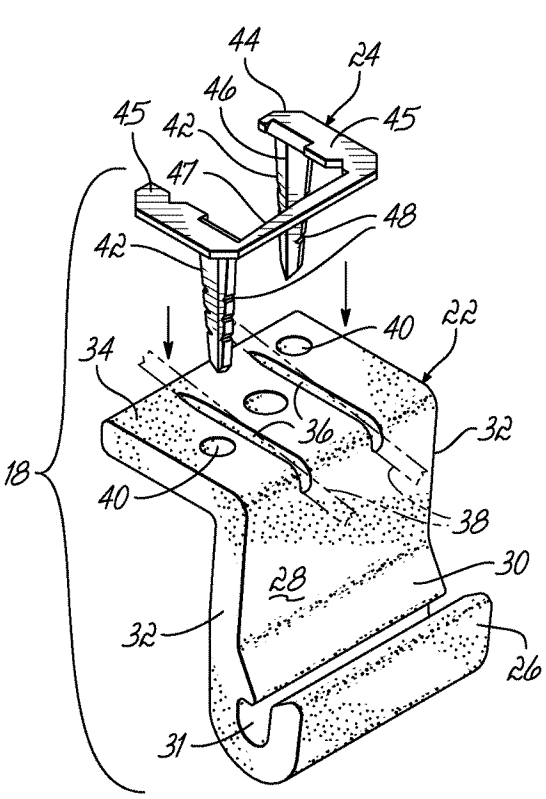
FIG. 6 is a partially disassembled view of a portion of the clip assembly of FIGS. 2B and 2C.

FIG. 6A illustrates an alternative clip assembly 18*a* having a first piece 22 identical to the one shown in FIG. 6 and a second piece 24*a* in which the tacks 24*a* are generally planar, lacking the crease and serrations 48 of each of the tacks 24 of the second piece 24 of clip assembly 18 shown in FIG. 6. As shown in FIG. 6A, each of the tacks 42*a* of second piece 24*a* of clip assembly 18*a* lacks the crease 46 and serrations 48 of each of the tacks 24 of the second piece 24 of clip assembly 18 shown in FIG. 6.

FIG. 6B illustrates an alternative clip assembly 18*b* having a first piece 22*b* slightly different than the first piece 22 shown in FIG. 6 and a second piece 24 identical to the second piece 24 of clip assembly 18 shown in FIG. 6. As shown in FIG. 6B, first piece 22*b* of clip assembly 18*b* lacks the openings 40 of the first piece 22 of clip assembly 18 shown in FIG. 6. In clip assembly 18*b*, the tacks 42 of the second piece 24 of clip assembly 18*b* may be driven through the material of the first piece 22*b* of clip assembly 18*b*. Alternatively, tacks like tacks 42*a* of the second piece 24*a* of clip assembly 18*a* may be used with a second piece of a clip assembly having no openings, in which case the tacks would be driven through the material of the first piece of the clip assembly. In any of the embodiments described or illustrated herein, the plastic or non-metallic piece of the clip assembly may lack openings, and the tacks of the metallic piece driven through the plastic or non-metallic material in order to secure the pieces of the clip assembly together.

As best illustrated in FIGS. 1, 2 and 2A, the tacks 42 of the second piece 24 of clip assembly 18 are secured inside one of the side walls 14 of furniture frame 12 with either an automated/mechanical machine or hand-held tool. When secured in place, the flange portion 34 of the first piece 22 of clip assembly 18 contacts or abuts an outer side surface 50 of one of the side walls 14 of furniture frame 12, and the body portion 28 of the first piece 22 of clip assembly 18 contacts or abuts an upper end surface 52 of one of the side walls 14 of furniture frame 12. As best shown in FIG. 2, the U-shaped hook portion 26 of the first piece 22 of clip assembly 18 is located generally above the inside side surface 54 of one of the side walls 14 of furniture frame 12.

FIG. 3 shows four clip assemblies 18 aligned in a similar orientation and having the flange portion 34 of the first piece 22 of clip assembly 18 contacting or proximate the body portion 28 of the first piece 22 of an adjacent clip assembly 18. When the clip assemblies are juxtaposed in such a manner, the grooves 36 of each clip assembly 18 are co-linearly aligned to permit a flexible connector 38 to be inserted into each of the aligned grooves 36 and extend the length of the aligned clip assemblies 18. As best shown in FIGS. 3-5, the two flexible connectors 38 are trapped or sandwiched between the first and second pieces 22, 24 of each clip assembly 18, each flexible connector being inside a plurality of aligned grooves 36 of multiple clip assemblies 18.

Although FIGS. 3-5 show four clip assemblies 18 aligned in a string 56 of aligned collated clip assemblies 18, the string 56 of aligned collated clip assemblies 18 may be made of any number of clip assemblies 18 connected together. In each of the aligned collated clip assemblies 18, the connectors 38 are trapped between the first and second pieces 22, 24 of the collated clip assembly 18.

The connectors 38 used to interconnect adjacent aligned clip assemblies 18 into a string 56 are preferably fabricated from a plastic material, such as a low density polyethylene or polyester plastic. The connectors 38 provide a flexibility in the collated string 56 of clip assemblies 18, which is needed when the string 56 is bent and rolled into a spool for insertion into a clinching tool. The connectors 38 have the required tensile strength to withstand pulling and twisting forces without breaking. Also, when a last clip assembly is cut off from the string 56, there are no sharp or jagged barbs left over to injure workers or tear fabric covering the clipped wires.

Figure 2C:
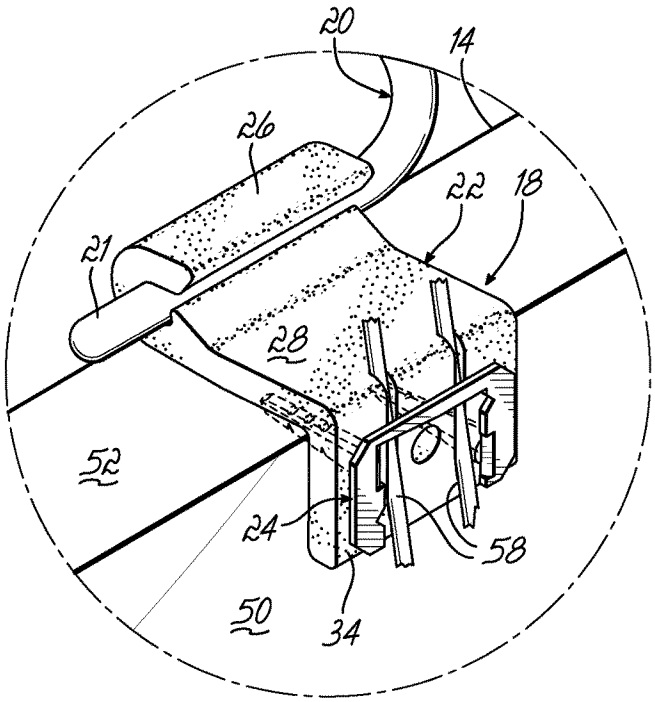
FIG. 2C is an enlarged view like the encircled area 2A showing pieces of connector secured to the clip assembly.
Figure 2B:
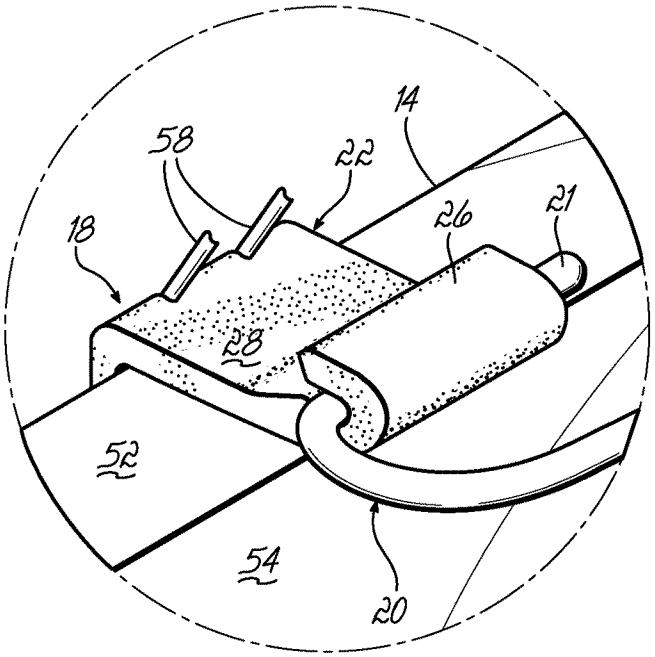
FIG. 2B is an enlarged view like the encircled area 2 showing pieces of connector secured to the clip assembly.

When used in a clipping tool, the connectors 38 may be broken between adjacent clip assemblies 18 in the collated string 56 of clip assemblies 18, leaving portions 58 of the connectors 38 with the clip assembly 18 secured to the frame 12. FIGS. 2B and 2C illustrate two such clip assemblies 18, each clip assembly 18 having portions 58 of the connectors 38 still with the clip assembly 18 when the clip assembly 18 is secured to one of the side walls 14 of frame 12.

Figure 3A:
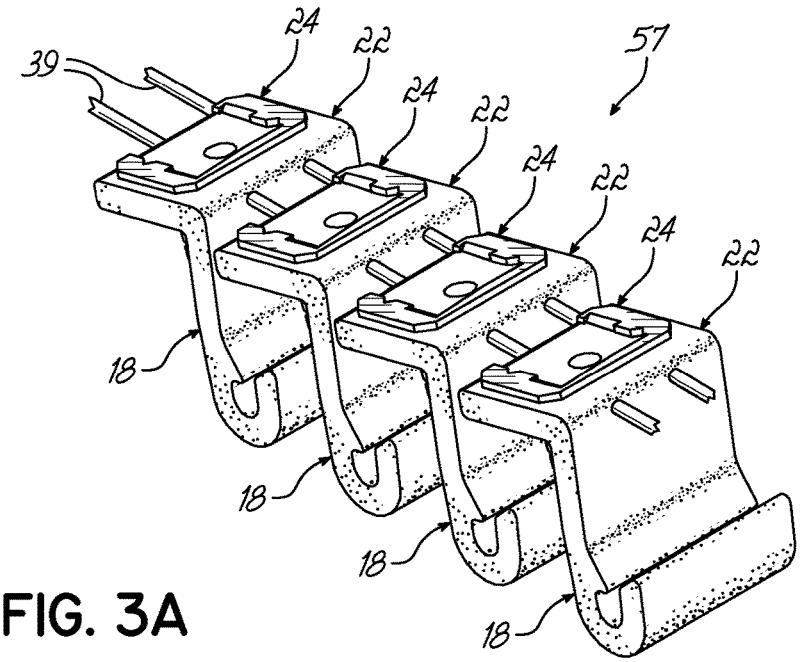
FIG. 3A is a perspective view of a portion of another collated string of clip assemblies.

FIG. 3A illustrates four clip assemblies 18 aligned in a string 57 of aligned collated clip assemblies. The string 57 of aligned collated clip assemblies 18 may be made of any number of clip assemblies 18 connected together using connectors 39. In each of the aligned collated clip assemblies 18, connectors 39, made from the material of the second pieces 22 of clip assemblies 18, extend between the second pieces 22 of adjacent clip assemblies 18. Connectors 39 may be broken where desired in a clipping tool.

Figure 9:
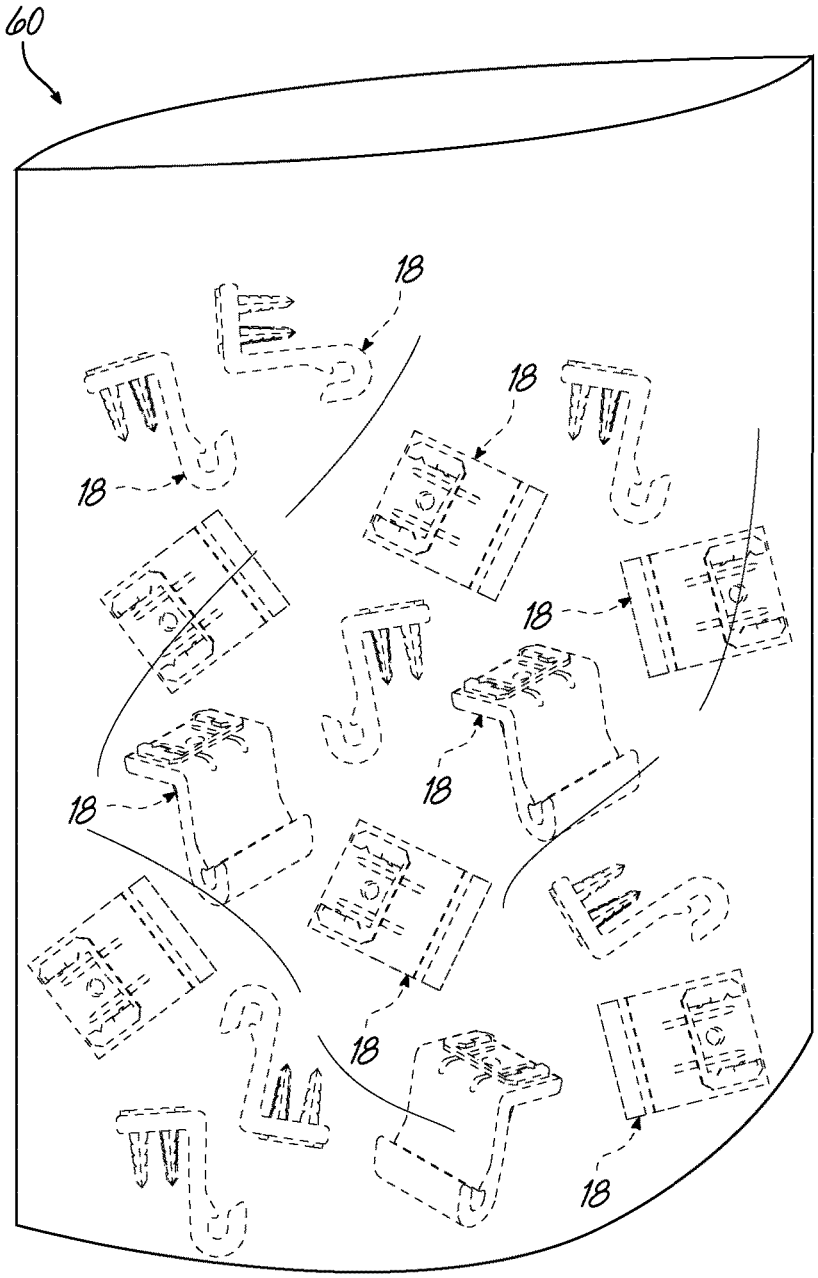
FIG. 9 is a perspective view of a bag or collection of clip assemblies.

FIG. 9 illustrates a package 60 of clip assemblies 18, which may be used to secure sinuous springs 20 to a frame 12, as described herein. However, in this embodiment of clip assembly 18, the second metallic piece 24 may or may not have any grooves. If the clip assemblies 18 lack the grooves, a plurality of such clip assemblies 18 may not be connected with flexible connectors 38, like clip assemblies 18. Therefore, the clip assemblies 18 may not be connected to each other and may be sold in a package 60 of individual clip assemblies.

Figure 10:
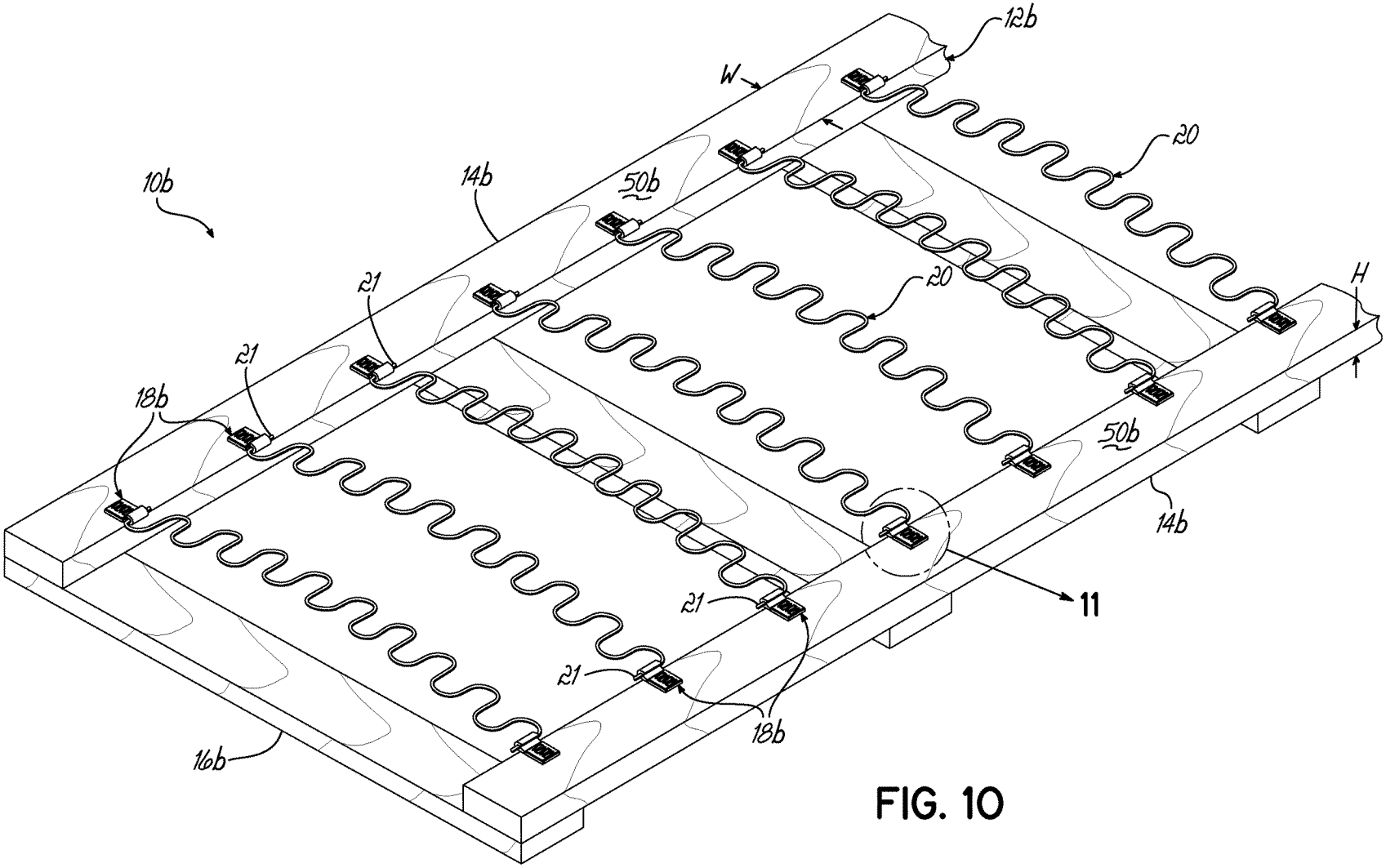
FIG. 10 is a perspective view of a frame and sinuous springs extending from one side to the other side of the frame, clip assemblies in accordance with another embodiment being secured to the frame sides, similar to FIG. 1.

FIG. 10 illustrates a portion of a piece of furniture 10*b* comprising a rectangular frame 12*b* comprising two side walls 14*b* and two end walls 16*b* (only one being shown in FIG. 10). The frame 12*b* is most commonly made of wood, but may be made of other suitable materials. In the embodiment of frame 12*b* shown in FIG. 10, each of the side and end walls 14*b*, 16*b*, respectively, is oriented such that the width "W" of each wall 14*b*, 16*b* is greater than its height "H".

As shown in FIG. 10, furniture piece 10*b* further comprises a plurality of clip assemblies 18*b* secured to the side walls 14*b* of the frame 12*b* in a spaced manner for securing and retaining a plurality of sinuous springs 20. Clip assemblies 18*b*, secured to opposed side walls 14*b*, are aligned to receive and retain end portions 21 of sinuous springs 20 in desired positions and under desired amounts of tension, as shown in FIG. 10. Commonly, such sinuous springs 20 are arched or bowed upwardly to provide resiliency to the furniture piece 10.

Figure 11A:
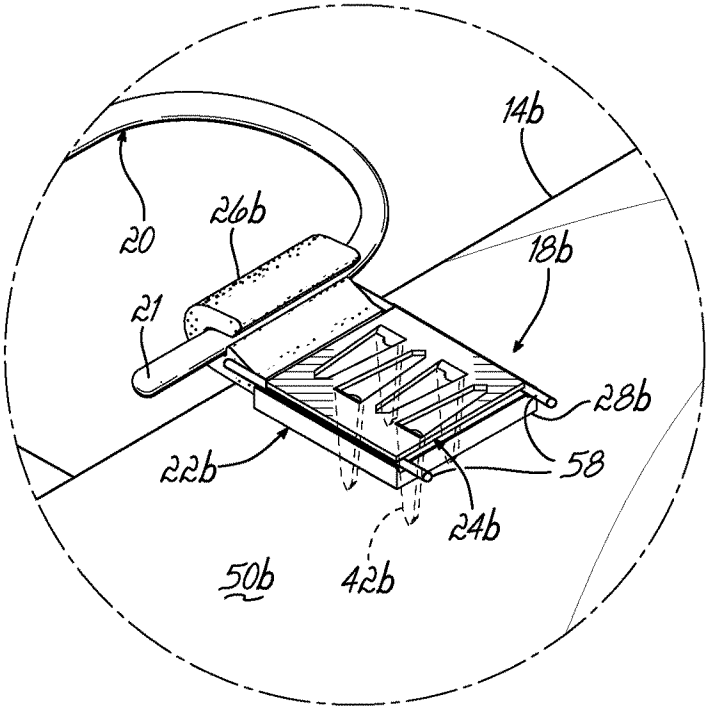
FIG. 11A is an enlarged view, similar to FIG. 11, of the clip assembly of FIG. 11 showing pieces of connector secured to the clip assembly.
Figure 11:
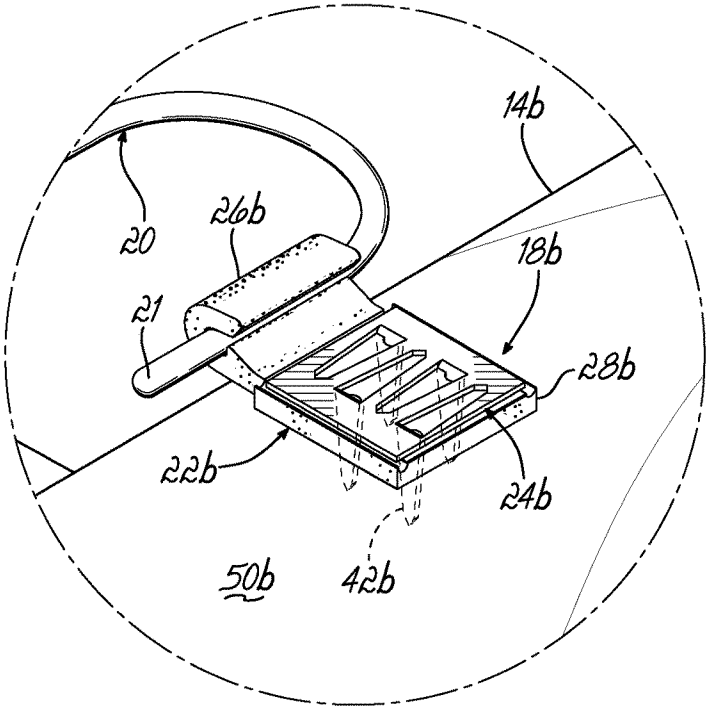
FIG. 11 is an enlarged view of the encircled area 11 of FIG. 10.
Figure 15:
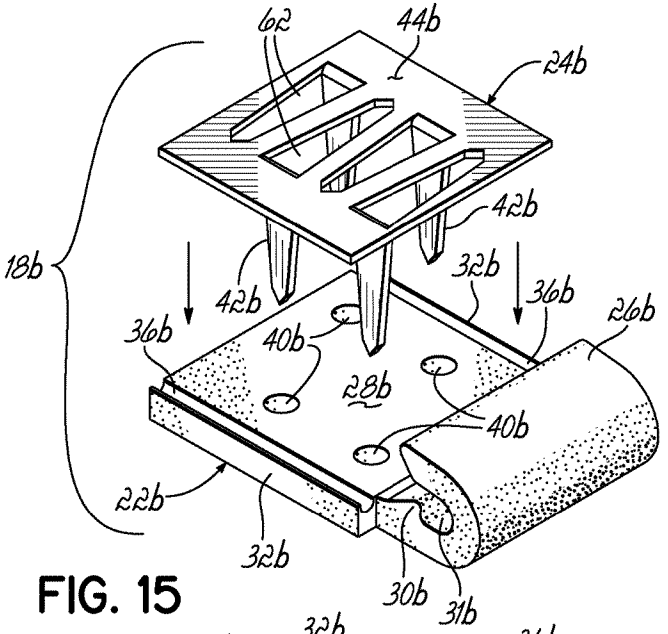
FIG. 15 is a partially disassembled view of a portion of the clip assembly of FIG. 11.
Figure 16:
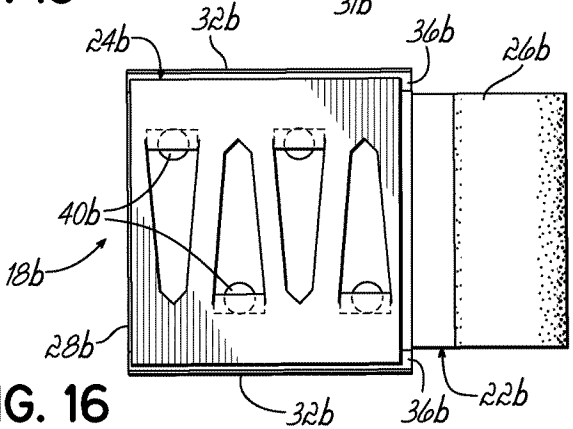
FIG. 16 is a top plan view of the clip assembly of FIG. 15.

FIGS. 11 and 11A each show one of the clip assemblies 18*b* secured to one of the side walls 14*b* of frame 12*b*. As best shown in FIG. 15, each clip assembly 18*b* comprises a first non-metallic piece 22*b*, usually made of plastic, and a second metal piece 24*b*, respectively. The pieces 22*b*, 24*b* are joined together and secured to one of the side walls 14*b* of the generally rectangular furniture frame 12*b*.

Figure 12:
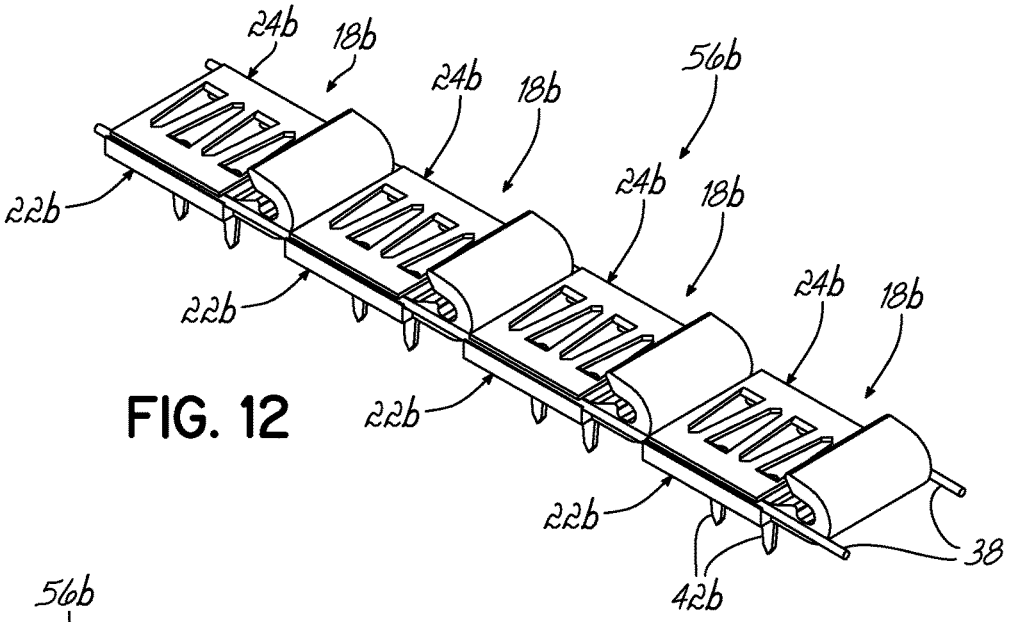
FIG. 12 is a perspective view of a portion of a collated string of clip assemblies of FIG. 10.
Figure 13:
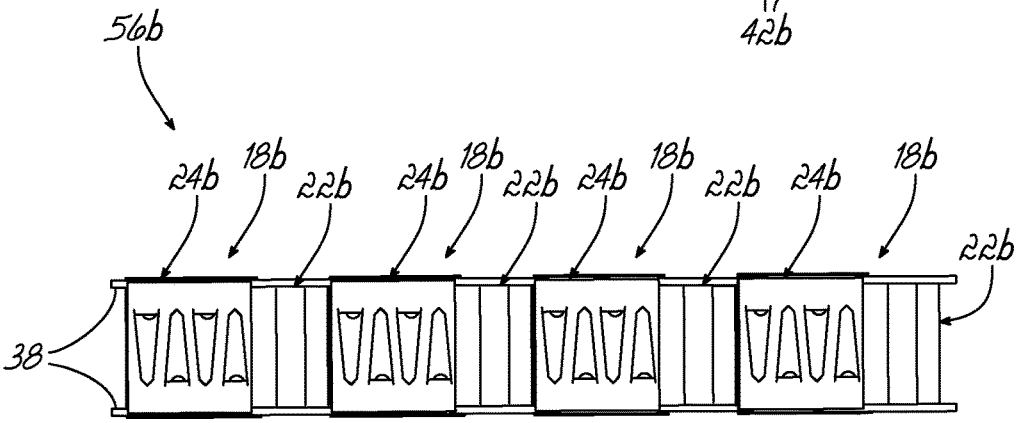
FIG. 13 is a top plan view of the portion of the collated string of clip assemblies of FIG. 12.
Figure 14:
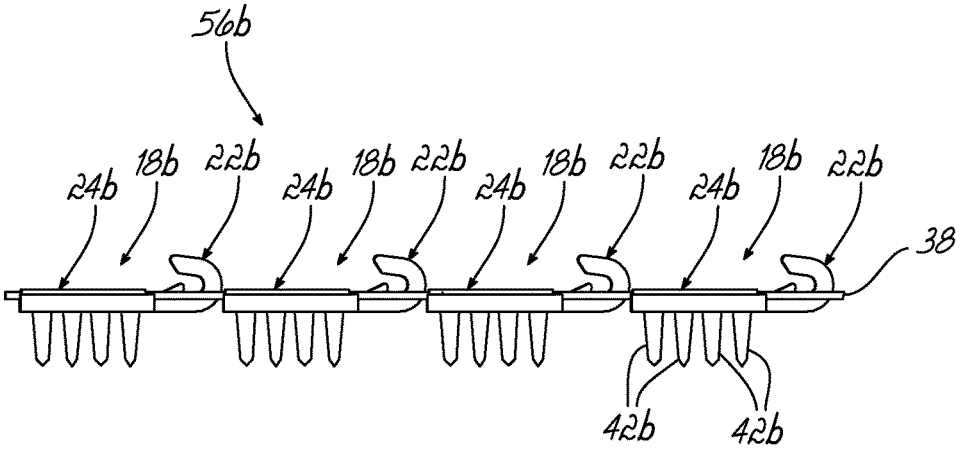
FIG. 14 is a side elevational view of the portion of the collated string of clip assemblies of FIG. 12.
Figure 15A:
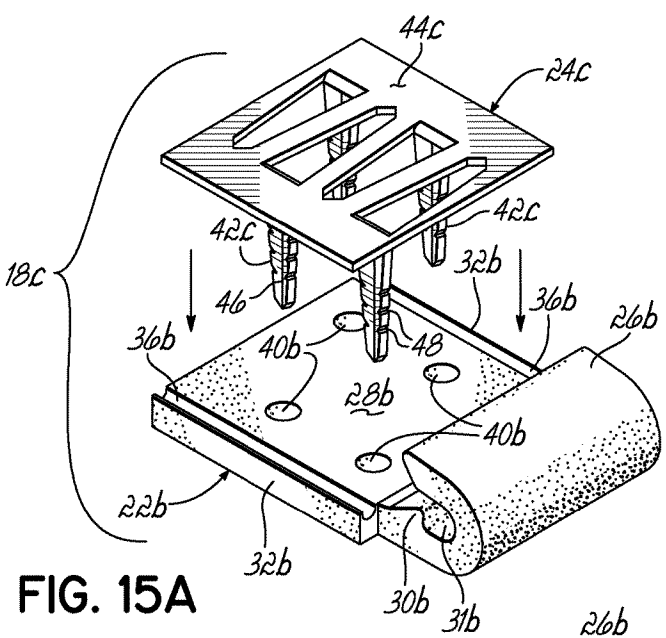
FIG. 15A is a partially disassembled view, similar to FIG. 15, of a portion of an alternative embodiment of clip assembly.
Figure 17:
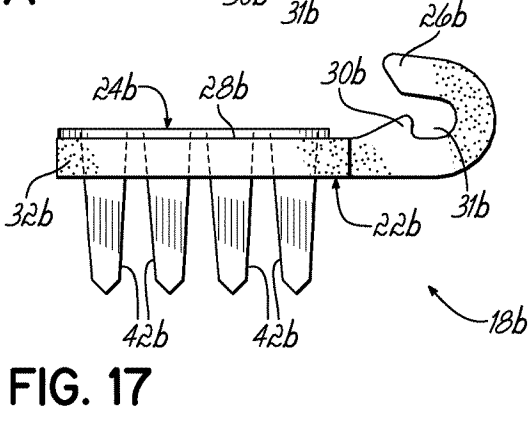
FIG. 17 is a side elevational view of the clip assembly of FIG. 15.

As best shown in FIG. 15, the first piece 22*b* of clip assembly 18*b* comprises a U-shaped hook portion 26*b* adapted to receive and retain an end portion 21 of one of the sinuous springs 20. The first piece 22*b* of clip assembly 18*b* further comprises a generally planar body portion 28*b*, which includes a ledge 30*b* extending from one side edge 32*b* to the opposed side edge 32*b* of the body portion 28*b* of the first piece 22*b* of the clip assembly 18*b*. When the end portion 21 of one of the sinuous springs 20 is inserted into the U-shaped hook portion 26*b*, the ledge 30*b* of the body portion 28*b* holds or retains the end portion 21 of the sinuous spring 20 in a receptacle 31*b*, illustrated in FIG. 17. As best shown in FIG. 15A, the body portion 28*b* of the first piece 22*b* of clip assembly 18*b* has a pair of spaced grooves 36*b* along the outer periphery of the body portion 16*b*, each of the grooves 36*b* being adapted to receive a non-metallic connector 38. Two connectors 38 connect multiple clip assemblies 18*b* together, as shown in FIGS. 12-14.

As shown in FIG. 15, the body portion 28*b* of the first piece 22*b* of clip assembly 18*b* has four openings 40*b*, each opening 40*b* extending through the thickness of the body portion 28*b* of the first piece 22*b* of clip assembly 18*b*. As best shown in FIG. 15, the second piece 24*b* of clip assembly 18*b* has four tacks 42*b* extending downwardly from a generally planar, generally body portion 44*b* of the second piece 24*b* of clip assembly 18*b*. More particularly, each of the tacks 42*b* is formed from material from the body portion 44*b* of the second piece 24*b* of clip assembly 18*b* using a punch press. The tacks 24*b* initially lie in the plane of the body portion 44*b* and are bent downwardly out of the plane, thereby leaving four openings 62 in the body portion 44*b* of the second piece 24*b* of clip assembly 18*b*. The tacks 42*b* of the second piece 24*b* of clip assembly 18*b* are located and sized to pass through the openings 40*b* of the first piece 22*b* of clip assembly 18*b*. Each of the tacks 42*b* of the second piece 24*b* of clip assembly 12 is generally planar, lacking the crease and serrations of the tacks 42*c* of the second piece 24*c* of clip assembly 18*c*, shown in FIG. 15A.

FIG. 15A illustrates an alternative clip assembly 18*c* having a first piece 22*b* identical to the one shown in FIG. 15 and a second piece 24*c* in which the tacks 42*c* has a crease 46 therein so the tack 42*c* has a non-planar cross-section. More particularly, the cross-section of each tack 42*c* has a generally "V-shape", as shown in FIG. 15A. As best shown in FIG. 15A, each of the tacks 42*c* of the second piece 24*c* of clip assembly 18*c* also has a plurality of serrations or indentations 48 to improve the holding strength of the clip assembly 18*c* to the wooden furniture frame.

As best illustrated in FIGS. 10, 11 and 11A, the tacks 42*b* of the second piece 24*b* of clip assembly 18*b* are secured inside one of the side walls 14*b* of furniture frame 12*b* with a clipping tool (not shown). When secured in place, the body portion 28*b* of the first piece 22*b* of clip assembly 18*b* contacts or abuts an upper side surface 50*b* of one of the side walls 14*b* of furniture frame 12*b*. As best shown in FIGS. 11 and 11*b*, the U-shaped hook portion 26*b* of the first piece 22*b* of clip assembly 18*b* is located generally towards the interior of the rectangular frame 12*b*.

FIG. 12 shows four clip assemblies 18*b* aligned in a similar orientation and having the body portion 28*b* of the first piece 22*b* of a clip assembly 18*b* contacting or proximate the U-shaped hook portion 26*b* of the first piece 22*b* of an adjacent clip assembly 18*b*. When the clip assemblies 18*b* are juxtaposed in such a manner, the grooves 36*b* of each clip assembly 18*b* are co-linearly aligned to permit a flexible connector 38 to be inserted into each of the aligned grooves 36*b* and extend the length of the aligned clip assemblies 18*b*. As best shown in FIGS. 12-14, the two flexible connectors 38 are trapped or sandwiched between the first and second pieces 22*b*, 24*b* of each clip assembly 18*b*, each flexible connector 38 being inside a plurality of aligned grooves 36*b* of multiple clip assemblies 18*b*.

Although FIGS. 12-14 show four clip assemblies 18*b* aligned in a string 56*b* of aligned collated clip assemblies 18*b*, the string 56*b* of aligned collated clip assemblies 18*b* may be made of any number of clip assemblies 18*b* connected together.

The connectors 38 used to interconnect adjacent aligned clip assemblies 18*b* into a string 56*b* are preferably fabricated from a plastic material, such as a low density polyethylene or polyester plastic. The connectors 38 provide a flexibility in the collated string 56*b* of clip assemblies 18*b*, which is needed when the string 56*b* is bent and rolled into a spool for insertion into a clipping tool. The connectors 38 have the required tensile strength to withstand pulling and twisting forces without breaking. Also, when a last clip assembly is cut off from the string 56*b*, there are no sharp or jagged barbs left over to injure workers or tear fabric covering the clipped wires.

When used in a clipping tool, the connectors 38 may be broken between adjacent clip assemblies 18*b* in the collated string 56*b* of clip assemblies 18*b*, leaving portions 58 of the connectors 38 with the clip assembly 18*b* secured to the frame 12*b*. FIG. 11A illustrates one such clip assembly 18*b*, each clip assembly 18*b* having portions 58 of the connectors 38 still with the clip assembly 18*b* when the clip assembly 18*b* is secured to one of the side walls 14*b* of frame 12*b*.

Figure 12A:
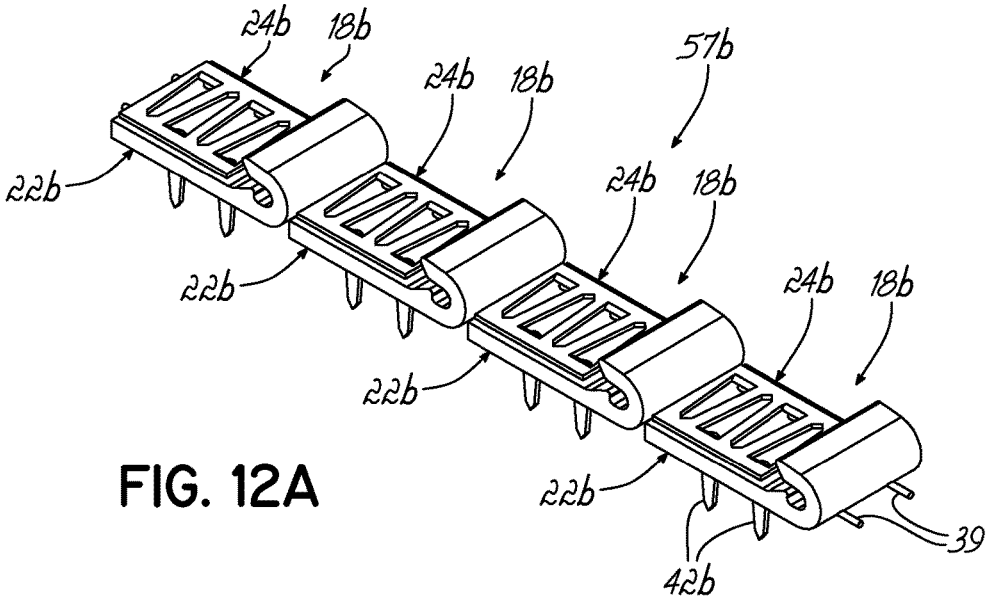
FIG. 12A is a perspective view of a portion of another collated string of clip assemblies.

FIG. 12A illustrates four clip assemblies 18*b* aligned in a string 57*b* of aligned collated clip assemblies. The string 57*b* of aligned collated clip assemblies 18*b* may be made of any number of clip assemblies 18*b* connected together using connectors 39. In each of the aligned collated clip assemblies 18*b*, connectors 39, made from the material of the second pieces 22*b* of clip assemblies 18*b*, extend between the second pieces 22*b* of adjacent clip assemblies 18*b*. Connectors 39 may be broken where desired in a clipping tool.

Figure 18:
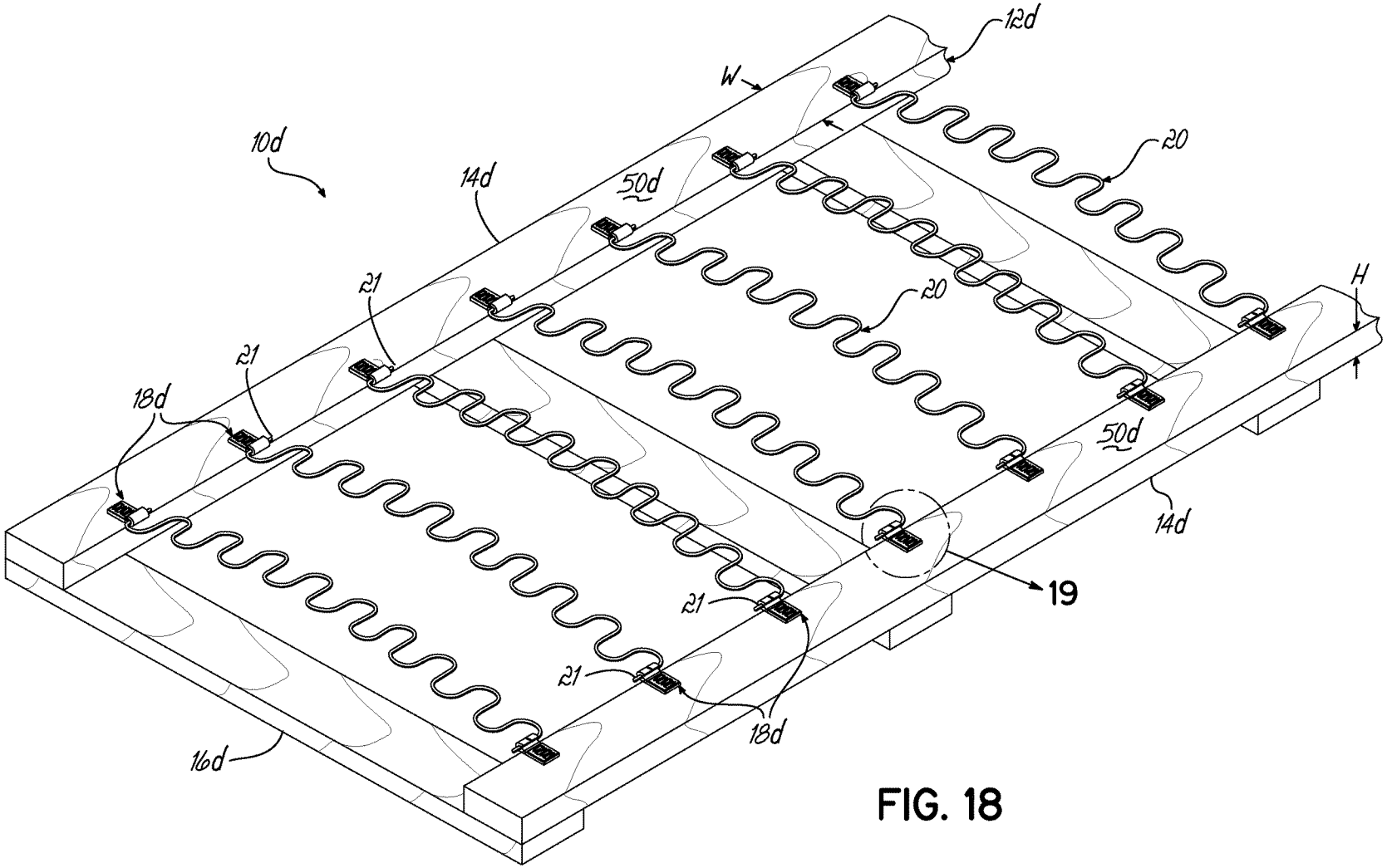
FIG. 18 is a perspective view of a furniture frame and sinuous springs extending from one side to the other side of the frame, clip assemblies in accordance with another embodiment being secured to the frame sides, similar to FIG. 10.

FIG. 18 illustrates a portion of a piece of furniture 10*d* comprising a rectangular frame 12*d* comprising two side walls 14*d* and two end walls 16*d* (only one being shown in FIG. 18). The frame 12*d* is most commonly made of wood, but may be made of other suitable materials. In the embodiment of frame 12*d* shown in FIG. 18, each of the side and end walls 14*d*, 16*d*, respectively, is oriented such that the width "W" of each wall 14*d*, 16*d* is greater than its height "H".

As shown in FIG. 18, furniture piece 10*d* further comprises a plurality of clip assemblies 18*d* secured to the side walls 14*d* of the frame 12*d* in a spaced manner for securing and retaining a plurality of sinuous springs 20. Clip assemblies 18*d*, secured to opposed side walls 14*d*, are aligned to receive and retain end portions 21 of sinuous springs 20 in desired positions and under a desired amount of tension, as shown in FIG. 18. Commonly, such sinuous springs 20 are arched or bowed upwardly to provide resiliency to the furniture piece 10*d*.

Figure 19A:
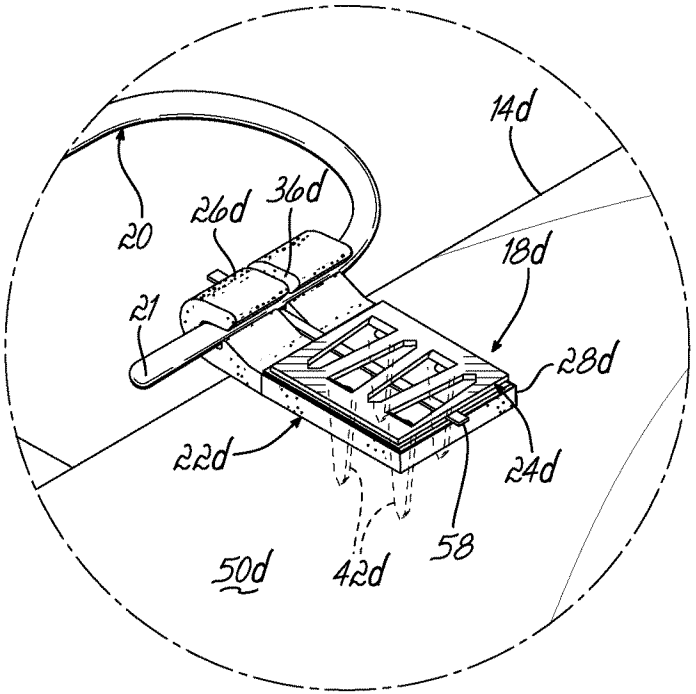
FIG. 19A is an enlarged view, similar to FIG. 19, of the clip assembly of FIG. 19 showing a piece of connector secured to the clip assembly.
Figure 19:
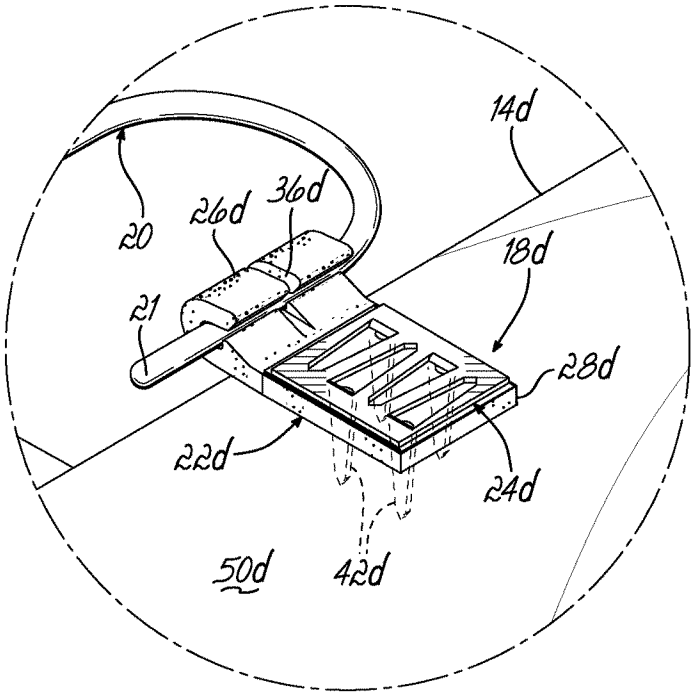
FIG. 19 is an enlarged view of the encircled area 19 of FIG. 18.
Figure 23:
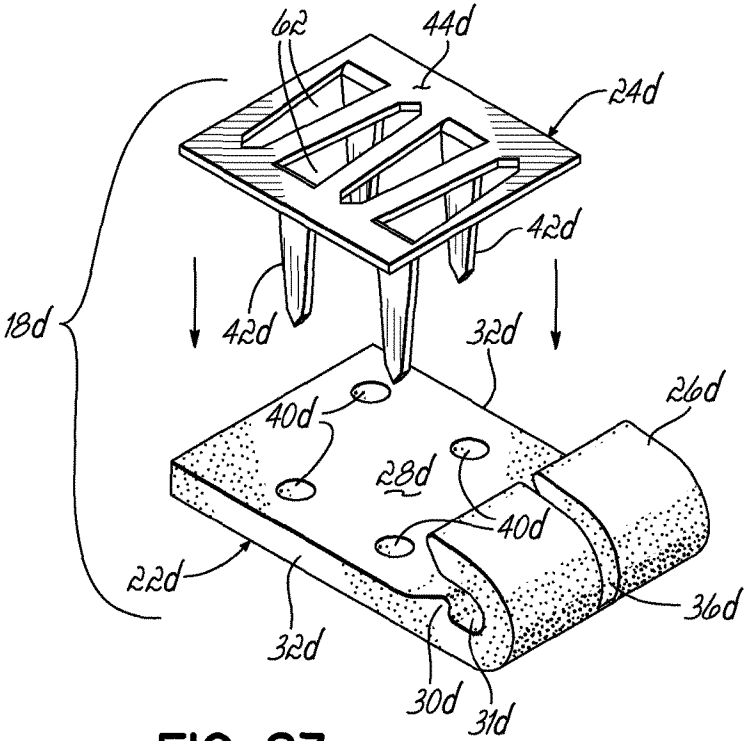
FIG. 23 is a partially disassembled view of a portion of the clip assembly of FIG. 18.

FIGS. 19 and 19A each show one of the clip assemblies 18*d* secured to one of the side walls 14*b* of frame 12*b*. As best shown in FIG. 23, each clip assembly 18*d* comprises a first non-metallic piece 22*d*, usually made of plastic, and a second metal piece 24*d*, respectively. The pieces 22*d*, 24*d* are joined together and secured to one of the side walls 14*d* of the generally rectangular furniture frame 12*d*.

Figure 21:
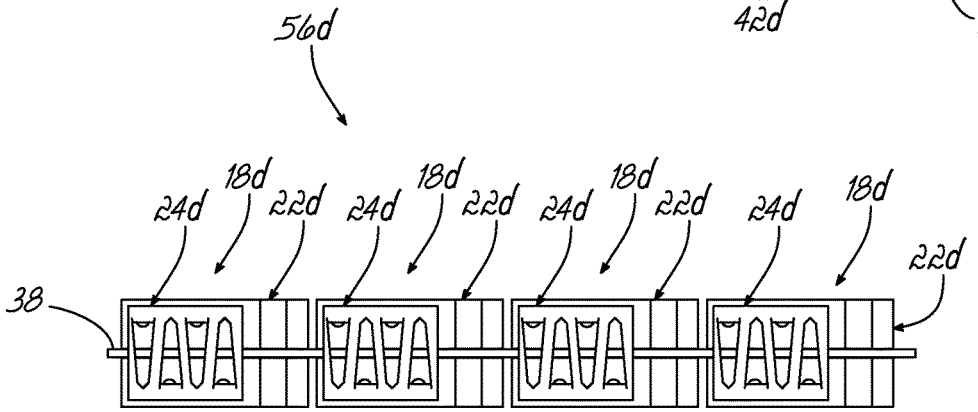
FIG. 21 is a top plan view of the portion of the collated string of clip assemblies of FIG. 20.
Figure 22:
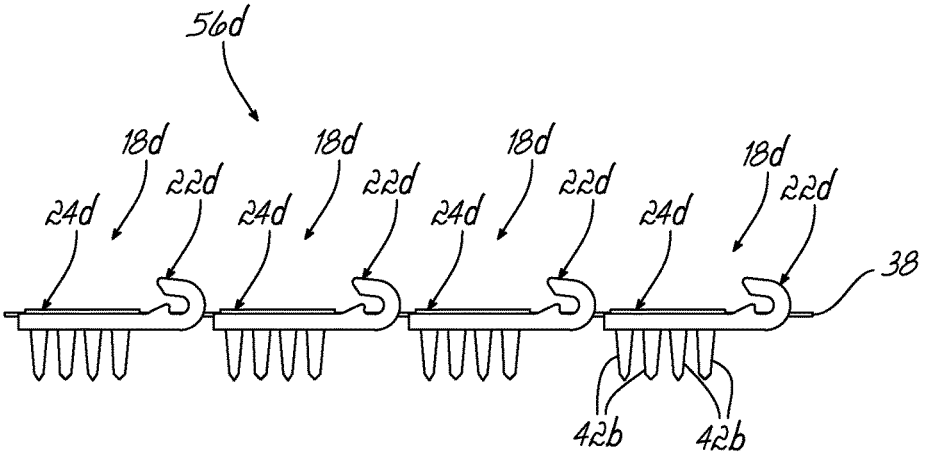
FIG. 22 is a side elevational view of the portion of the collated string of clip assemblies of FIG. 20.
Figure 24:
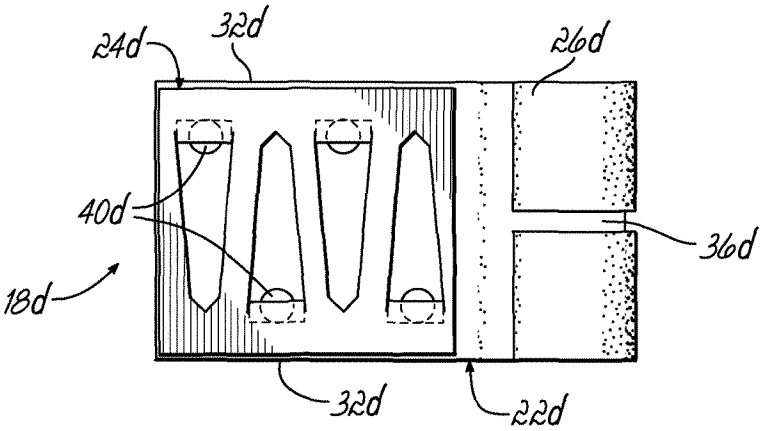
FIG. 24 is a top plan view of the clip assembly of FIG. 23.
Figure 25:
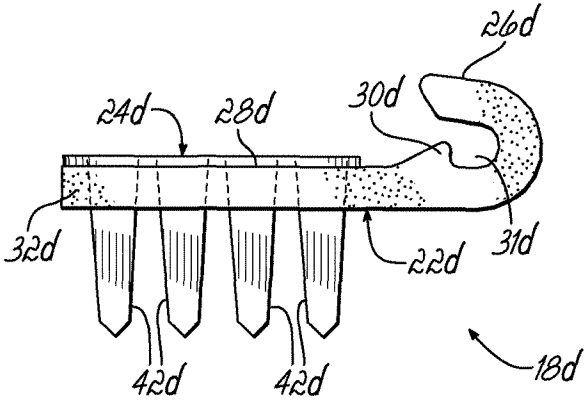
FIG. 25 is a side elevational view of the clip assembly of FIG. 23.

As shown in FIG. 23, the first piece 22*d* of clip assembly 18*d* comprises a U-shaped hook portion 26*d* adapted to receive and retain an end portion 21 of one of the sinuous springs 20. The first piece 22*d* of clip assembly 18*d* further comprises a generally planar body portion 28*d*, which includes a ledge 30*d* extending from one side edge 32*d* to the opposed side edge 32*d* of the body portion 28*d* of the first piece 22*d* of the clip assembly 18*d*. When the end portion 21 of one of the sinuous springs 20 is inserted into the U-shaped hook portion 26*d*, the ledge 30*d* of the body portion 28*d* holds or retains the end portion 21 of the sinuous spring 20 in a receptacle 31*d*, illustrated in FIG. 25. As best shown in FIG. 23, the U-shaped hook portion 26*d* of the first piece 22*d* of clip assembly 18*d* has a groove 36*d* extending inwardly from the outer surface of the U-shaped hook portion 26*d*, the groove 36*d* being adapted to receive a non-metallic connector 38. One connector 38 connects multiple clip assemblies 18*d* together, as shown in FIGS. 20-22.

As shown in FIG. 23, the body portion 28*d* of the first piece 22*d* of clip assembly 18*d* has four openings 40*d*, each opening 40*d* extending through the thickness of the body portion 28*d* of the first piece 22*d* of clip assembly 18*d*. As best shown in FIG. 23, the second piece 24*d* of clip assembly 18*d* has four tacks 42*d* extending downwardly from a generally planar, generally body portion 44*d* of the second piece 24*d* of clip assembly 18*d*. More particularly, each of the tacks 42*d* is formed from material from the body portion 44*d* of the second piece 24*d* of clip assembly 18*d* using a punch press. The tacks 24*d* initially lie in the plane of the body portion 44*d* and are bent downwardly out of the plane, thereby leaving four openings 62 in the body portion 44*d* of the second piece 24*d* of clip assembly 18*d*. The tacks 42*d* of the second piece 24*d* of clip assembly 18*b* are located and sized to pass through the openings 40*d* of the first piece 22*d* of clip assembly 18*d*. Each of the tacks 42*d* of the second piece 24*d* of clip assembly 12 are generally planar, lacking the crease and serrations of the tacks 42*c* of the second piece 24*c* of clip assembly 18*c*, shown in FIG. 15A. However, the tacks 42*d* of the second piece 24*d* of clip assembly 18*d* may have creases or serrations, as illustrated and described herein.

As best illustrated in FIGS. 18, 19 and 19A, the tacks 42*d* of the second piece 24*d* of clip assembly 18*d* are secured inside one of the side walls 14*d* of furniture frame 12*d* with a clipping tool (not shown). When secured in place, the body portion 28*d* of the first piece 22*d* of clip assembly 18*d* contacts or abuts an upper side surface 50*d* of one of the side walls 14*d* of furniture frame 12*d*. As best shown in FIGS. 19 and 19A, the U-shaped hook portion 26*d* of the first piece 22*d* of clip assembly 18*d* is located generally towards the interior of the rectangular frame 12*d*.

Figure 20:
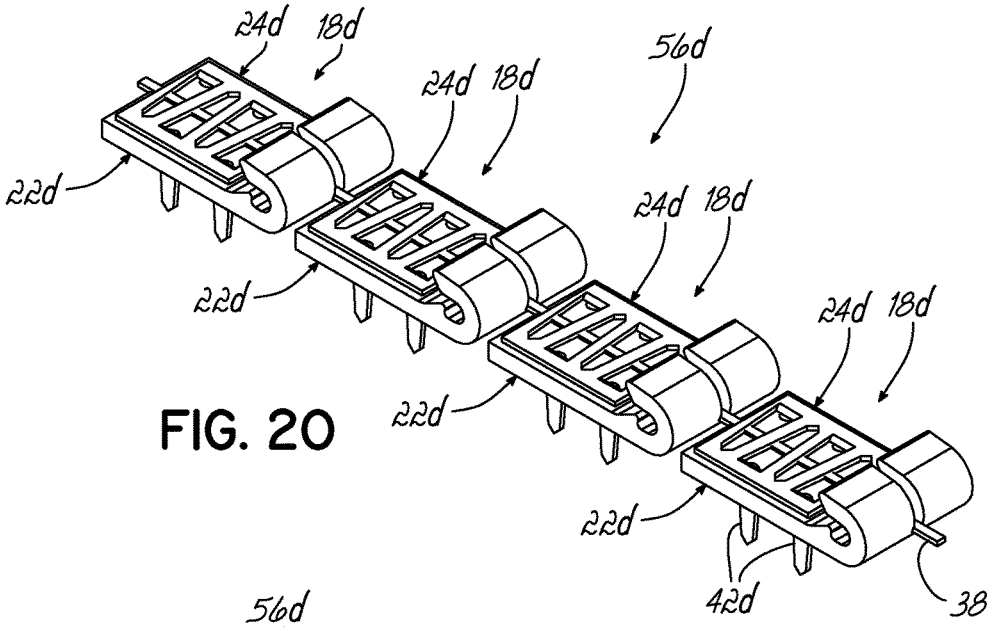
FIG. 20 is a perspective view of a portion of a collated string of clip assemblies of FIG. 18.

FIG. 20 shows four clip assemblies 18*d* aligned in a similar orientation and having the body portion 28*d* of the first piece 22*d* of a clip assembly 18*d* contacting or proximate the U-shaped hook portion 26*d* of the first piece 22*d* of an adjacent clip assembly 18*d*. When the clip assemblies 18*d* are juxtaposed in such a manner, the groove 36*d* of each clip assembly 18*b* is co-linearly aligned to permit a flexible connector 38 to be inserted into the aligned grooves 36*d* and extend the length of the aligned clip assemblies 18*d*. As best shown in FIGS. 20-22, the flexible connector 38 is trapped or sandwiched between the first and second pieces 22*d*, 24*d* of each clip assembly 18*d*, each flexible connector 38 being inside a plurality of aligned grooves 36*d* of multiple clip assemblies 18*d*.

Although FIGS. 20-22 show four clip assemblies 18*d* aligned in a string 56*d* of aligned collated clip assemblies 18*d*, the string 56*d* of aligned collated clip assemblies 18*d* may be made of any number of clip assemblies 18*d* connected together.

The connector 38 used to interconnect adjacent aligned clip assemblies 18*d* into a string 56*d* is preferably fabricated from a plastic material, such as a low density polyethylene or polyester plastic. The connector 38 provides a flexibility in the collated string 56*d* of clip assemblies 18*d*, which is needed when the string 56*d* is bent and rolled into a spool for insertion into a clipping tool. The connector 38 has the required tensile strength to withstand pulling and twisting forces without breaking. Also, when a last clip assembly is cut off from the string 56*d*, there are no sharp or jagged barbs left over to injure workers or tear fabric covering the clipped wires.

When used in a clipping tool, the connector 38 may be broken between adjacent clip assemblies 18*d* in the collated string 56*d* of clip assemblies 18*d*, leaving portions 58 of the connector 38 with the clip assembly 18*d* secured to the frame 12*d*. FIG. 19A illustrates one such clip assembly 18*d*, each clip assembly 18*d* having portions 58 of the connector 38 still with the clip assembly 18*d* when the clip assembly 18*d* is secured to one of the side walls 14*d* of frame 12*d*.

Figure 26:
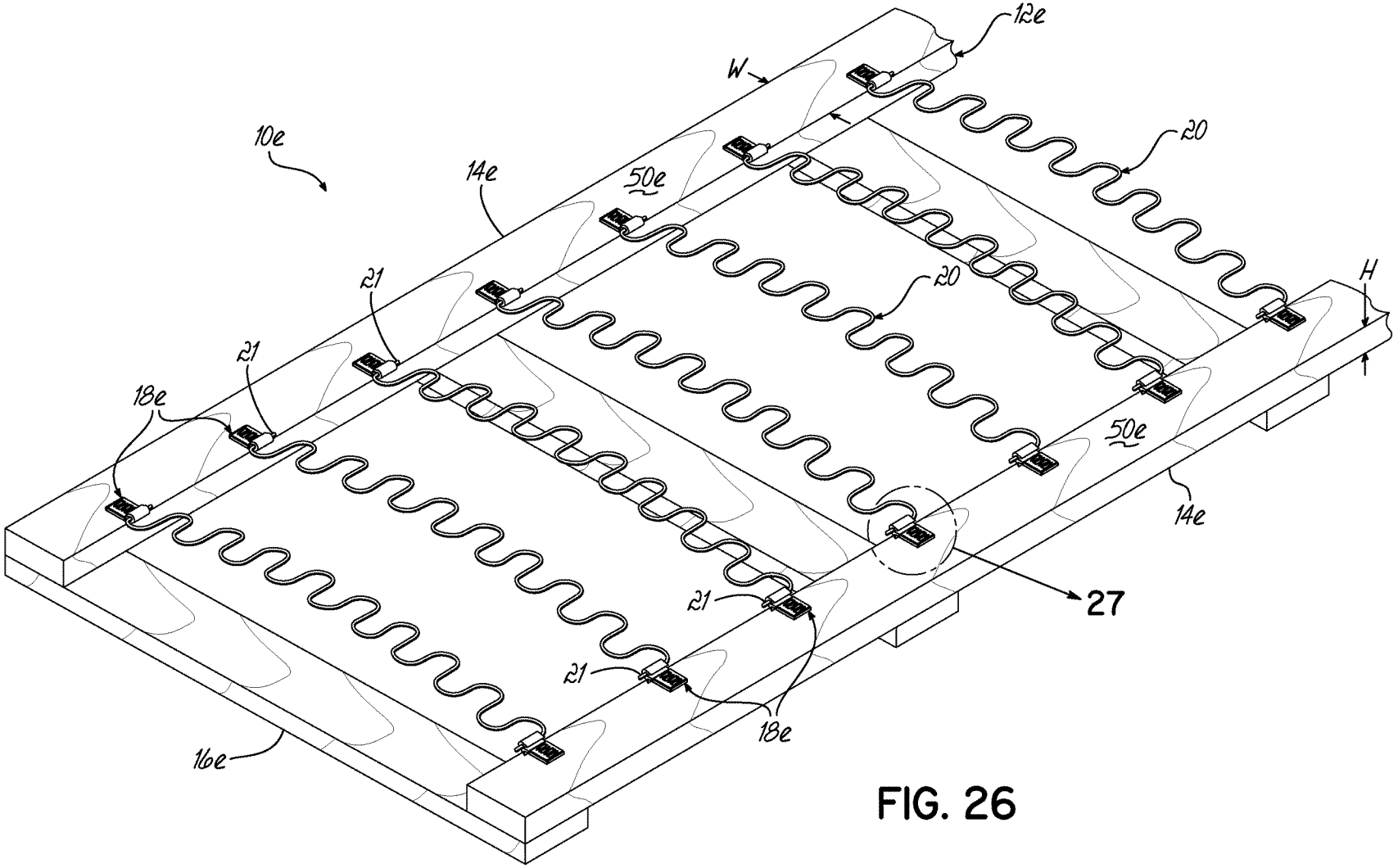
FIG. 26 is a perspective view of a furniture frame and sinuous springs extending from one side to the other side of the frame, clip assemblies in accordance with another embodiment being secured to the frame sides, similar to FIG. 18.

FIG. 26 illustrates a portion of a piece of furniture 10*e* comprising a rectangular frame 12*e* comprising two side walls 14*e* and two end walls 16*e* (only one being shown in FIG. 26). The frame 12*e* is most commonly made of wood, but may be made of other suitable materials. In the embodiment of frame 12*e* shown in FIG. 26, each of the side and end walls 14*e*, 16*e*, respectively, is oriented such that the width "W" of each wall 14*e*, 16*e* is greater than its height "H".

As shown in FIG. 26, furniture piece 10*e* further comprises a plurality of clip assemblies 18*e* secured to the side walls 14*e* of the frame 12*e* in a spaced manner for securing and retaining a plurality of sinuous springs 20. Clip assemblies 18*e*, secured to opposed side walls 14*e*, are aligned to receive and retain an end portion 21 of a sinuous spring 20 in a desired position and under a desired amount of tension, as shown in FIG. 26. Commonly, such sinuous springs 20 are arched or bowed upwardly to provide resiliency to the furniture piece 10*e*.

Figure 27A:
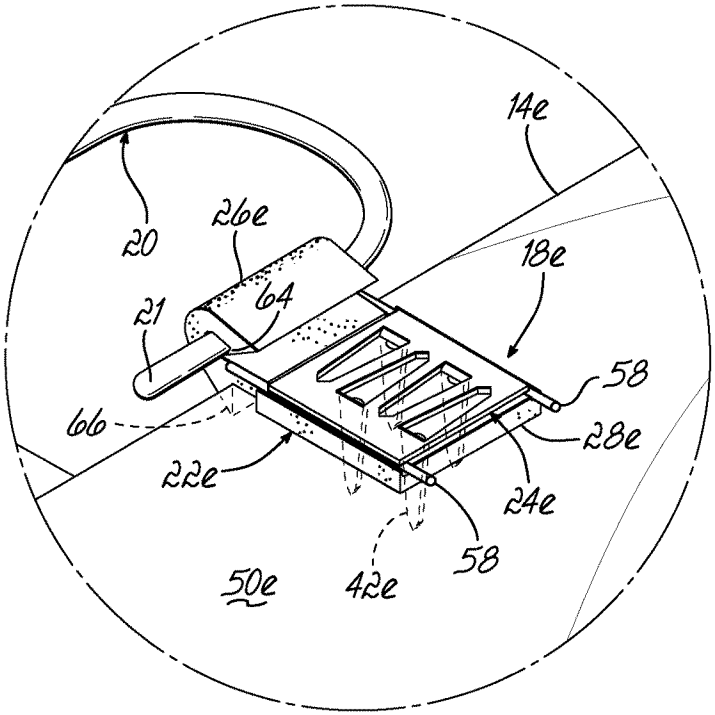
FIG. 27A is an enlarged view, similar to FIG. 27, of the clip assembly of FIG. 26 showing pieces of connectors secured to the clip assembly.
Figure 27:
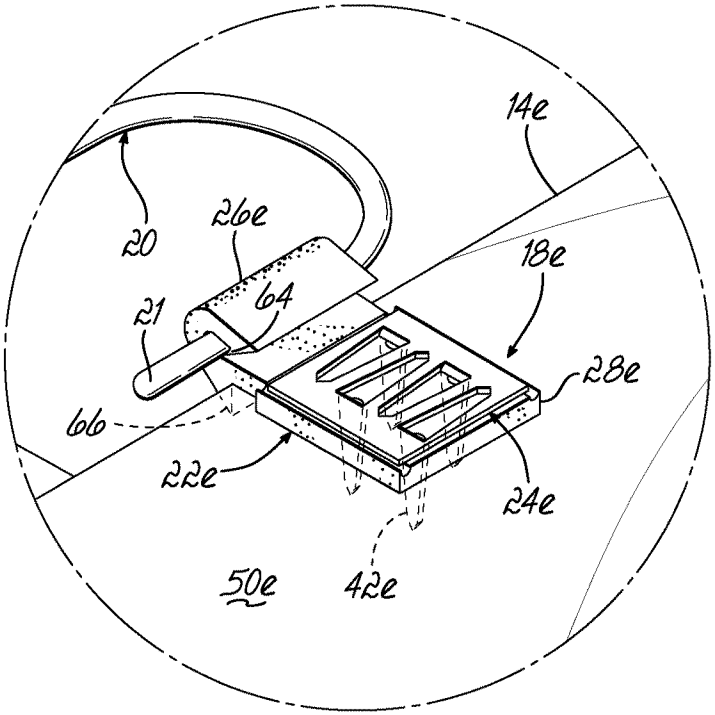
FIG. 27 is an enlarged view of the encircled area 27 of FIG. 26.
Figure 31:
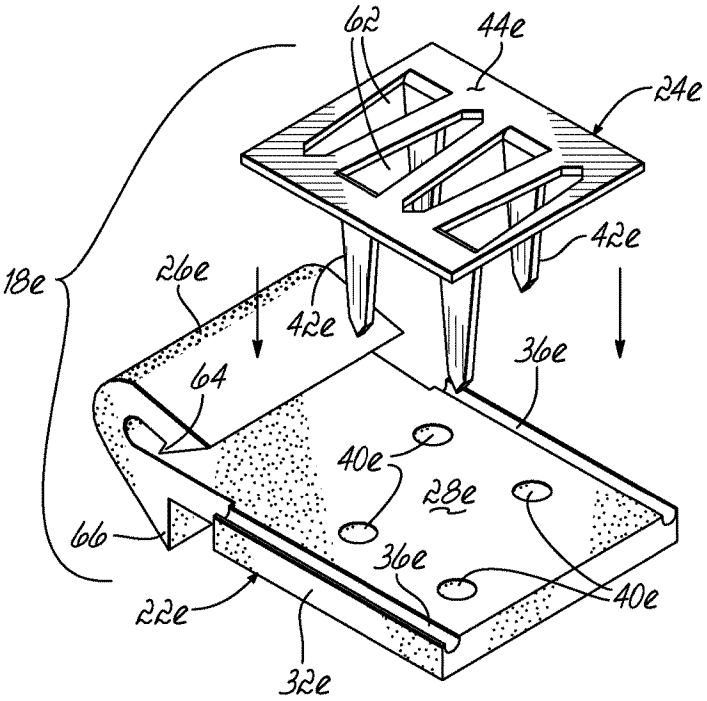
FIG. 31 is a partially disassembled view of a portion of the clip assembly of FIG. 28.

FIGS. 27 and 27A each show one of the clip assemblies 18*e* secured to one of the side walls 14*e* of frame 12*e*. As best shown in FIG. 31, each clip assembly 18*e* comprises a first non-metallic piece 22*e*, usually made of plastic, and a second metal piece 24*e*, respectively. The pieces 22*e*, 24*e* are joined together and secured to one of the side walls 14*e* of the generally rectangular furniture frame 12*e*.

Figure 29:
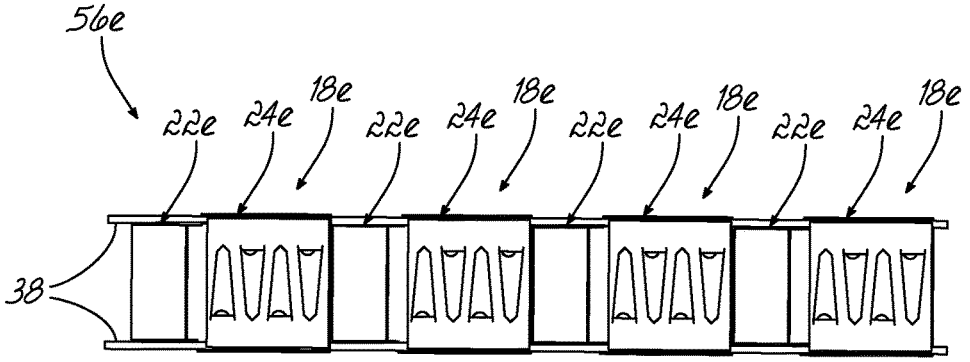
FIG. 29 is a top plan view of the portion of the collated string of clip assemblies of FIG. 28.
Figure 30:
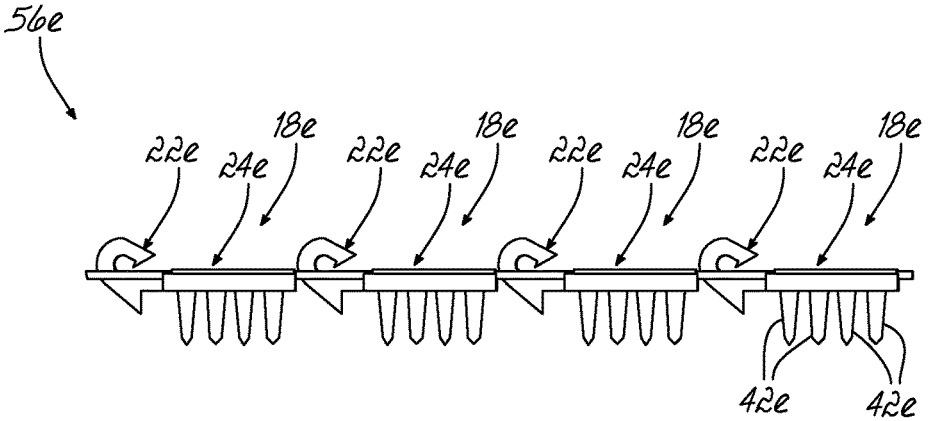
FIG. 30 is a side elevational view of the portion of the collated string of clip assemblies of FIG. 28.
Figure 32:
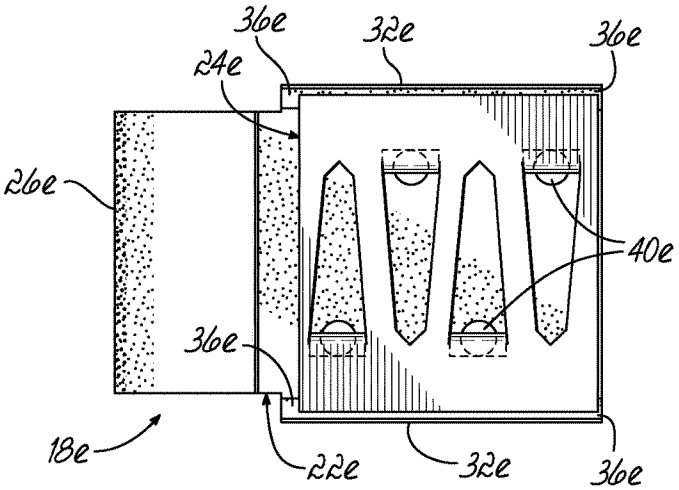
FIG. 32 is a top plan view of the clip assembly of FIG. 28.
Figure 33:
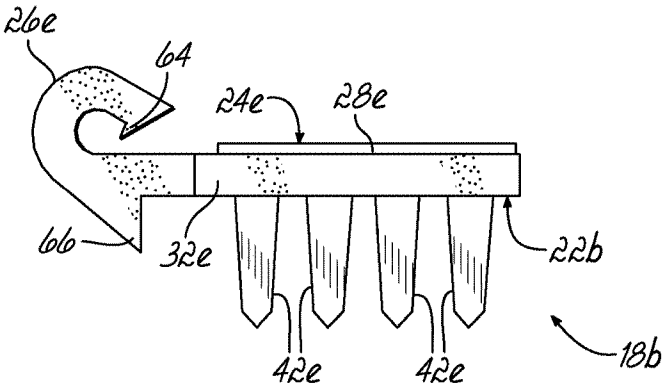
FIG. 33 is a side elevational view of the clip assembly of FIG. 28.

The first piece 22*e* of clip assembly 18*e* comprises a U-shaped hook portion 26*e* adapted to receive and retain an end portion 21 of one of the sinuous springs 20 having an end ledge 64. The first piece 22*e* of clip assembly 18*e* further comprises a generally planar body portion 28*e*, which includes a stop 66 extending from one side edge 32*e* to the opposed side edge 32*e* of the body portion 28*e* of the first piece 22*e* of the clip assembly 18*e*. When the end portion 21 of one of the sinuous springs 20 is inserted into the U-shaped hook portion 26*e*, the stop 66 of the body portion 28*e* abuts the frame 12*e*, as shown in FIG. 27. The U-shaped hook portion 26*e* holds or retains the end portion 21 of the sinuous spring 20 in a receptacle 31*e*, illustrated in FIG. 27. As best shown in FIG. 27A, the body portion 28*e* of the first piece 22*e* of clip assembly 18*e* has a pair of spaced grooves 36*e* along the outer periphery of the body portion 28*e*, each of the grooves 36*e* being adapted to receive a non-metallic connector 38. Two connectors 38 connect multiple clip assemblies 18*e* together, as shown in FIGS. 28-30.

As shown in FIG. 27, the body portion 28*e* of the first piece 22*e* of clip assembly 18*e* has four openings 40*e*, each opening 40*e* extending through the thickness of the body portion 28*e* of the first piece 22*e* of clip assembly 18*e*. As best shown in FIG. 27, the second piece 24*e* of clip assembly 18*e* has four tacks 42*e* extending downwardly from a generally planar, generally body portion 44*e* of the second piece 24*e* of clip assembly 18*e*. More particularly, each of the tacks 42*e* is formed from material from the body portion 44*e* of the second piece 24*e* of clip assembly 18*e*, using a punch press. The tacks 24*e* initially lie in the plane of the body portion 44*e* and are bent downwardly out of the plane, thereby leaving four openings 62 in the body portion 44*e* of the second piece 24*e* of clip assembly 18*e*. The tacks 42*e* of the second piece 24*e* of clip assembly 18*e* are located and sized to pass through the openings 40*e* of the first piece 22*e* of clip assembly 18*e*. Each of the tacks 42*e* of the second piece 24*e* of clip assembly 12 is generally planar, lacking the crease of the tacks 42*c* of the second piece 24*c* of clip assembly 18*c* shown in FIG. 15A. However, the tacks 42*e* of the second piece 24*e* of clip assembly 18*e* may have creases or serrations, as illustrated and described herein.

As best illustrated in FIGS. 26, 27 and 27A, the tacks 42*e* of the second piece 24*e* of clip assembly 18*e* are secured inside one of the side walls 14*e* of furniture frame 12*e* with a clipping tool (not shown). When secured in place, the body portion 28*e* of the first piece 22*e* of clip assembly 18*e* contacts or abuts an upper side surface 50*e* of one of the side walls 14*e* of furniture frame 12*e*. As best shown in FIGS. 27 and 27A, the U-shaped hook portion 26*e* of the first piece 22*e* of clip assembly 18*e* is located generally towards the interior of the rectangular frame 12*e*.

Figure 28:
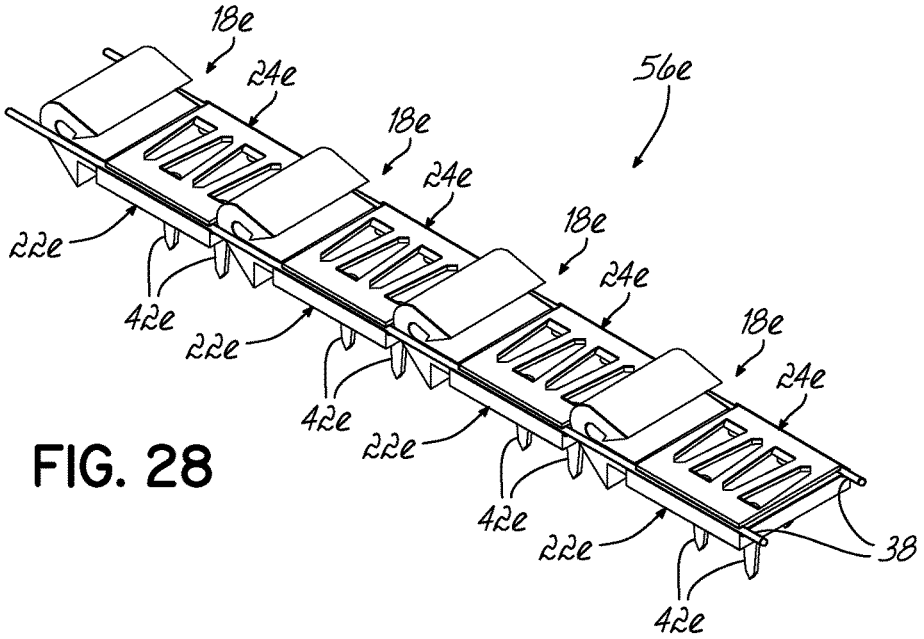
FIG. 28 is a perspective view of a portion of a collated string of clip assemblies of FIG. 26.

FIG. 28 shows four clip assemblies 18*e* aligned in a similar orientation and having the body portion 28*e* of the first piece 22*e* of a clip assembly 18*e* contacting or proximate the U-shaped hook portion 26*e* of the first piece 22*e* of an adjacent clip assembly 18*e*. When the clip assemblies 18*e* are juxtaposed in such a manner, the grooves 36*e* of each clip assembly 18*e* are co-linearly aligned to permit a flexible connector 38 to be inserted into each of the aligned grooves 36 and extend the length of the aligned clip assemblies 18*e*. As best shown in FIGS. 28-30, the two flexible connectors 38 are trapped or sandwiched between the first and second pieces 22*e*, 24*e* of each clip assembly 18*e*, each flexible connector 38 being inside a plurality of aligned grooves 36*e* of multiple clip assemblies 18*e*.

Although FIGS. 28-30 show four clip assemblies 18*e* aligned in a string 56*e* of aligned collated clip assemblies 18*e*, the string 56*e* of aligned collated clip assemblies 18*e* may be made of any number of clip assemblies 18*e* connected together.

The connectors 38 used to interconnect adjacent aligned clip assemblies 18*e* into a string 56*e* are preferably fabricated from a plastic material, such as a low density polyethylene or polyester plastic. The connectors 38 provide a flexibility in the collated string 56*e* of clip assemblies 18*e*, which is needed when the string 56*e* is bent and rolled into a spool for insertion into a clipping tool. The connectors 38 have the required tensile strength to withstand pulling and twisting forces without breaking. Also, when a last clip assembly is cut off from the string 56*e*, there are no sharp or jagged barbs left over to injure workers or tear fabric covering the clipped wires.

When used in a clipping tool, the connectors 38 may be broken between adjacent clip assemblies 18*e* in the collated string 56*e* of clip assemblies 18*e*, leaving portions 58 of the connectors 38 with the clip assembly 18*e* secured to the frame 12*e*. FIG. 27A illustrates one such clip assembly 18*e*, each clip assembly 18*e* having portions 58 of the connectors 38 still with the clip assembly 18*e* when the clip assembly 18*e* is secured to one of the side walls 14*e* of frame 12*e*.

Figure 34:
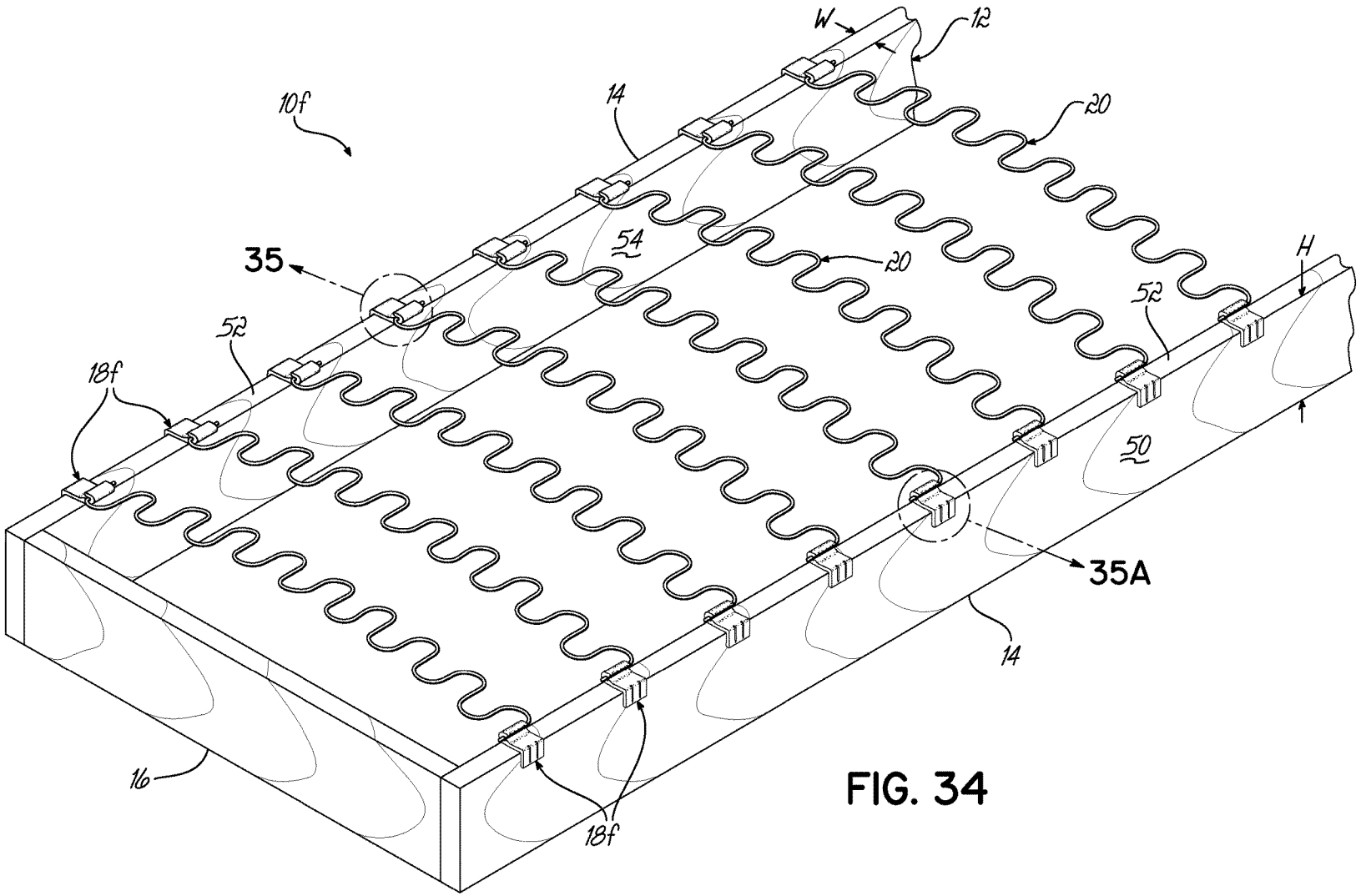
FIG. 34 is a perspective view of a furniture frame and sinuous springs extending from one side to the other side of the frame, clip assemblies in accordance with one embodiment being secured to the frame sides.

FIG. 34 illustrates a portion of a piece of furniture 10*f* comprising a rectangular frame 12 comprising two side walls 14 and two end walls 16 (only one being shown in FIG. 34). The frame 12 is the same frame illustrated in FIG. 1.

As shown in FIG. 34, furniture piece 10*f* further comprises a plurality of clip assemblies 18*f* secured to the side walls 14 of the frame 12 in a spaced manner for securing and retaining a plurality of sinuous springs 20. Clip assemblies 18*f*, secured to opposed side walls 14, are aligned to receive and retain end portions 21 of sinuous springs 20 in desired positions and under desired amounts of tension, as shown in FIG. 34. Commonly, such sinuous springs 20 are arched or bowed upwardly to provide resiliency to the furniture piece 10*f*.

Figure 35A:
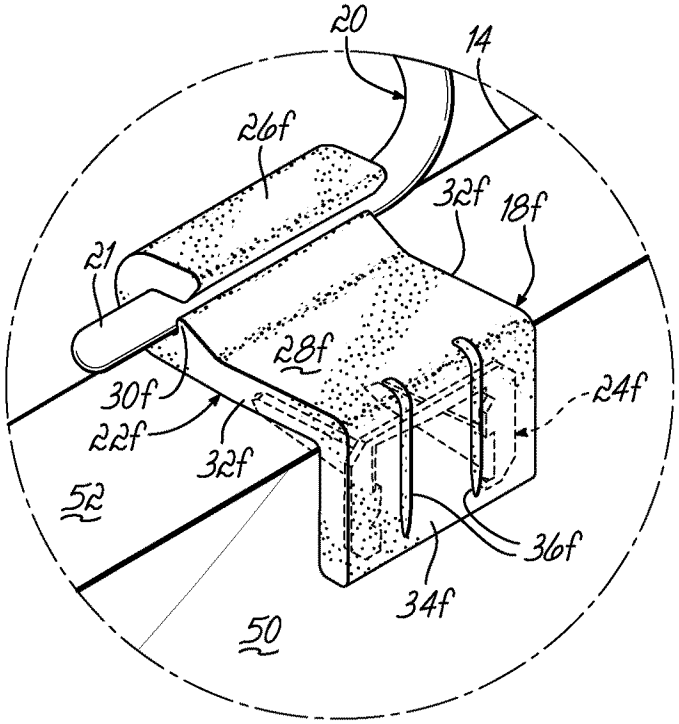
FIG. 35A is an enlarged view of the encircled area 35A of FIG. 34.
Figure 35:
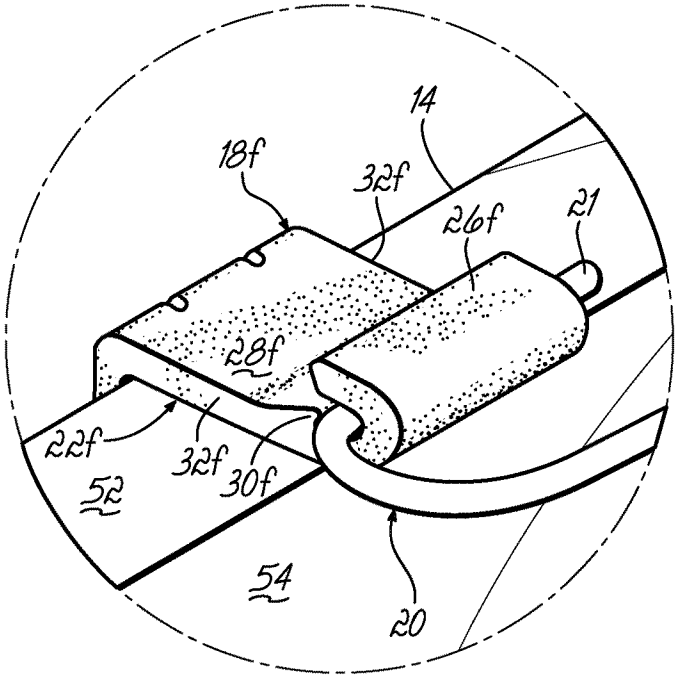
FIG. 35 is an enlarged view of the encircled area 35 of FIG. 34.

FIGS. 35 and 35A each show one of the clip assemblies 18*f* secured to one of the side walls 14 of frame 12. As best shown in FIG. 35A, each clip assembly 18*f* comprises a first non-metallic piece or clip 22*f*, usually made of plastic, and a second metal piece or fastener 24*f* molded together into a unitary member. Each clip assembly 18*f* is secured to one of the side walls 14 of the generally rectangular furniture frame 12, with the tacks or projections 42*f* of the clip assembly 18*f* being embedded in the frame side wall 14.

Figure 36:
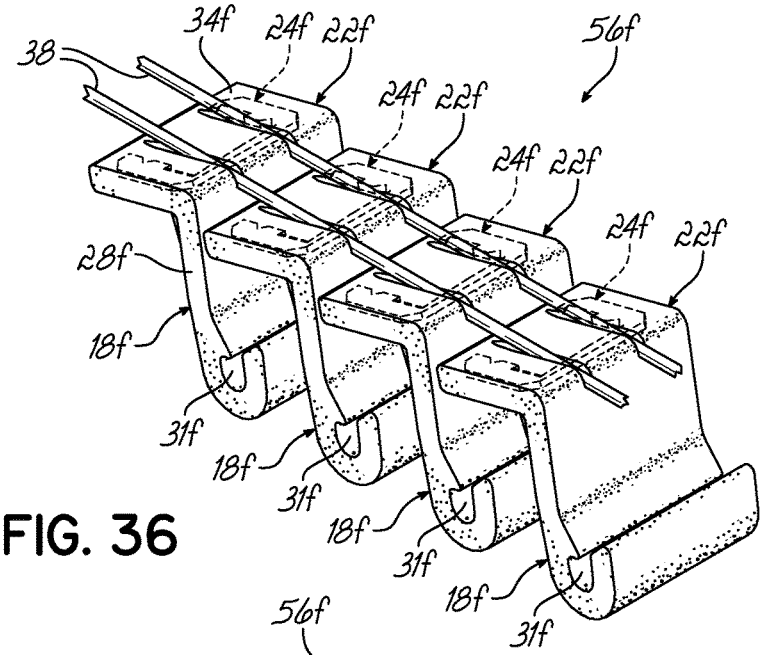
FIG. 36 is a perspective view of a portion of a collated string of clip assemblies of FIG. 34.
Figure 37:
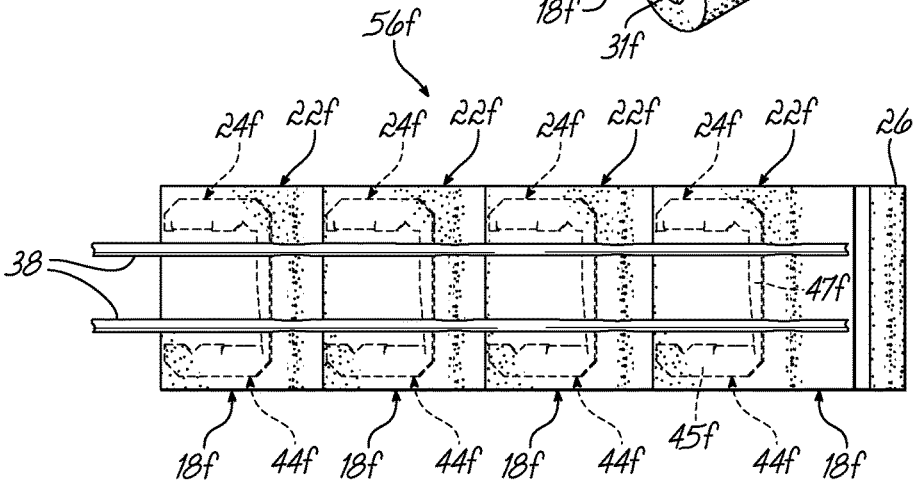
FIG. 37 is a top plan view of the portion of the collated string of clip assemblies of FIG. 36.
Figure 38:
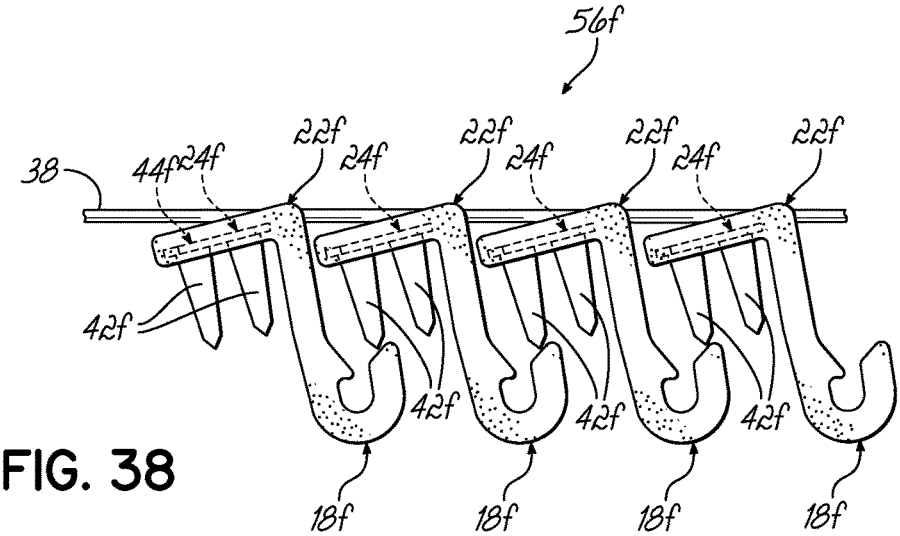
FIG. 38 is a side elevational view of the portion of the collated string of clip assemblies of FIG. 36.

As best shown in FIGS. 35 and 35A, the first piece 22*f* of clip assembly 18*f* comprises a U-shaped hook portion 26*f* adapted to receive and retain an end portion 21 of one of the sinuous springs 20. The first piece 18*f* further comprises a generally planar body portion 28*f* which includes a ledge 30*f* extending from one side edge 32*f* to the opposed side edge 32*f* of the body portion 28*f* of the first piece 22*f* of the clip assembly 18*f*. When the end portion 21 of one of the sinuous springs 20 is inserted into the U-shaped hook portion 26*f*, the ledge 30*f* of the body portion 28*f* holds or retains the end portion 21 of the sinuous spring 20 in a receptacle 31*f*, illustrated in FIG. 36. The first piece 22*f* of clip assembly 18*f* further comprises a generally planar flange portion 34*f* extending outwardly from the end of the body portion 28*f* opposite the U-shaped hook portion 26*f* in a direction generally orthogonal or perpendicular to the body portion 28*f*. As best shown in FIG. 35A, the flange portion 34*f* of the first piece 22*f* of clip assembly 18*f* has a pair of spaced parallel grooves 36*f* adapted to receive non-metallic connectors 38 which connect multiple clip assemblies 18*f* together, as shown in FIGS. 36-38. In some embodiments, the grooves 36*f* may be omitted. For example, clip assemblies 18*g* shown in FIGS. 39-40A lack grooves.

As best shown in FIGS. 35A-38, the second piece 24*f* of clip assembly 18*f* has a pair of tacks 42*f* extending downwardly from a generally planar, generally U-shaped body portion 44*f* of the second piece 24*f* of clip assembly 18*f*. More particularly, each of the tacks 42*f* extends downwardly from one of the sides 45*f* of the generally U-shaped body portion 44*f* of the second piece 24*f* of clip assembly 18*f*. As best shown in FIG. 37, the sides 45*f* of the generally U-shaped body portion 44*f* of the second piece 24*f* of clip assembly 18*f* are connected by a connecting portion 47*f*. Although the generally planar body portion 44*f* of clip assembly 18*f* is illustrated as being generally U-shaped, it may be generally rectangular or any other desired shape. The drawings are not intended to limit the configuration of the generally planar body portion 44*f* of clip assembly 18*f*.

As best shown in FIGS. 35A-38, the generally planar body portion 44*f* of clip assembly 18*f* is encased by or surrounded by the flange portion 34*f* of the first piece 22*f* of clip assembly 18*f* during a molding process. As best shown in FIG. 38, tacks 42*f* of the second piece 24*f* of clip assembly 18*f* are located and sized to pass through the flange portion 34*f* of the first piece 22*f* of clip assembly 18*f*. Each of the tacks 42*f* of the second piece 24*f* of clip assembly 18*f* is illustrated as being generally planar like the tacks 42*a* shown in FIG. 6A. However, each of the tacks 42*f* may have a crease therein so the tack 42*f* has a non-planar cross-section. Although not shown, the cross-section of each tack 42*f* may have a generally "V-shape", as shown in FIGS. 6 and 6B. Although not shown, each of the tacks 42*f* of the second piece 24*f* of clip assembly 18*f*, whether creased or not, may have a plurality of vertically spaced serrations or indentations like the serrations or indentations 48 shown in tacks 42 in FIGS. 6, 6B and 8 to improve the holding strength of the clip assembly 18*f* to the furniture frame 12.

As best illustrated in FIGS. 34, 35 and 35A, the tacks 42*f* of the second piece 24*f* of clip assembly 18*f* are secured inside one of the side walls 14 of furniture frame 12 with either an automated/mechanical machine or hand-held tool. When secured in place, the flange portion 34*f* of the first piece 22*f* of clip assembly 18*f* contacts or abuts an outer side surface 50 of one of the side walls 14 of furniture frame 12, and the body portion 28*f* of the first piece 22*f* of clip assembly 18*f* contacts or abuts an upper end surface 52 of one of the side walls 14 of furniture frame 12. As best shown in FIG. 35, the U-shaped hook portion 26*f* of the first piece 22*f* of clip assembly 18*f* is located generally above the inside side surface 54 of one of the side walls 14 of furniture frame 12. The tacks 42*f* of the clip assembly 18*f* enter the side walls 14 through the outer side surfaces 50 of the side walls 14 as shown in FIG. 35A.

FIG. 36 shows four clip assemblies 18*f* aligned in a similar orientation and having the flange portion 34*f* of the first piece 22*f* of clip assembly 18*f* contacting or proximate the body portion 28*f* of the first piece 22*f* of an adjacent clip assembly 18*f*. When the clip assemblies 18*f* are juxtaposed in such a manner, the grooves 36*f* of each clip assembly 18*f* are co-linearly aligned to permit a flexible connector 38 to be inserted into each of the aligned grooves 36 and extend the length of the aligned clip assemblies 18*f*. As best shown in FIGS. 36-38, the two flexible connectors 38 are trapped or sandwiched in the first piece 22*f* of each clip assembly 18*f*, each flexible connector 38 being inside a plurality of aligned grooves 36*f* of multiple clip assemblies 18*f*.

Although FIGS. 36-38 show four clip assemblies 18*f* aligned in a string 56*f* of aligned collated clip assemblies 18*f*, the string 56*f* of aligned collated clip assemblies 18*f* may be made of any number of clip assemblies 18*f* connected together using connectors 38. In each of the aligned collated clip assemblies 18*f*, the connectors 38 are trapped inside the grooves 36*f* of the collated clip assembly 18*f*.

The connectors 38 used to interconnect adjacent aligned clip assemblies 18*f* into a string 56*f* are preferably fabricated from a plastic material, such as a low density polyethylene or polyester plastic. The connectors 38 provide flexibility in the collated string 56*f* of clip assemblies 18*f* which is needed when the string 56*f* is bent and rolled into a spool for insertion into a clinching tool. The connectors 38 have the required tensile strength to withstand pulling and twisting forces without breaking. Also, when a last clip assembly 18*f* is cut off from the string 56*f*, there are no sharp or jagged barbs left over to injure workers or tear fabric covering the clipped wires.

Figure 35C:
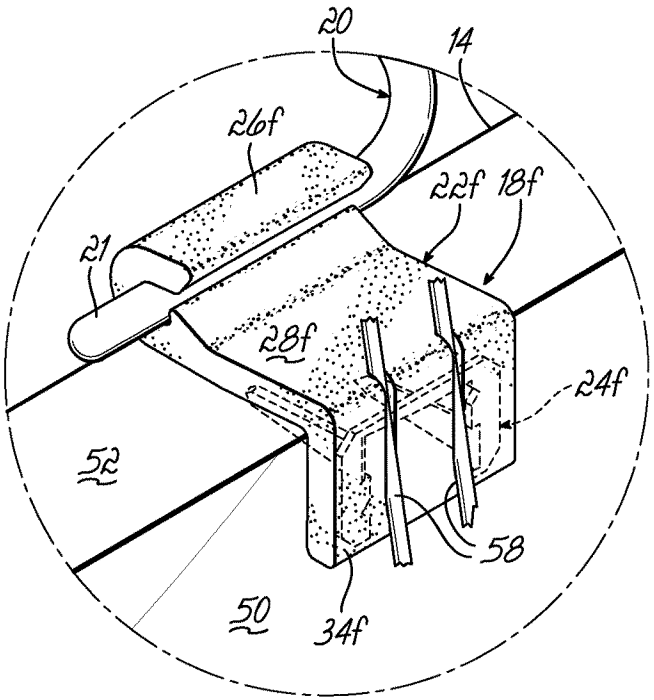
FIG. 35C is an enlarged view like the encircled area 35A showing pieces of connector secured to the clip assembly.
Figure 35B:
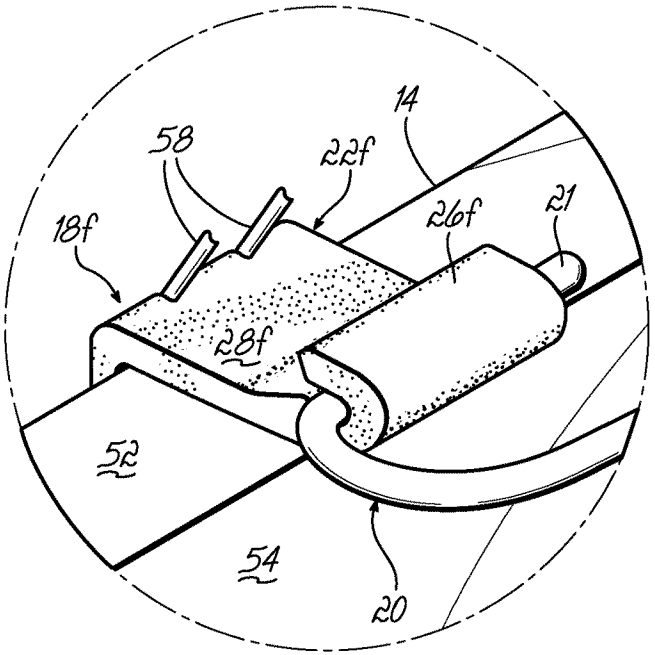
FIG. 35B is an enlarged view like the encircled area 35 showing pieces of connector secured to the clip assembly.

When used in a clipping tool, the connectors 38 may be broken between adjacent clip assemblies 18*f* in the collated string 56*f* of clip assemblies 18*f*, leaving portions 58 of the connectors 38 with the clip assembly 18*f* secured to the frame 12. FIGS. 35B and 35C illustrate two such clip assemblies 18*f*, each clip assembly 18*f* having portions 58 of the connectors 38 still with the clip assembly 18*f* when the clip assembly 18*f* is secured to one of the side walls 14 of frame 12.

Figure 36A:
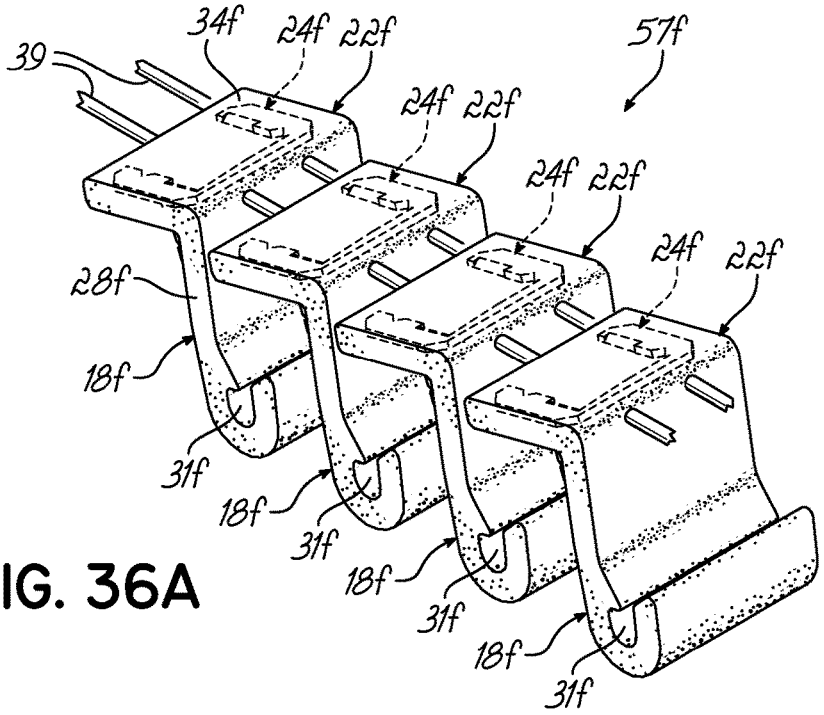
FIG. 36A is a perspective view of a portion of another collated string of clip assemblies.

FIG. 36A illustrates four clip assemblies 18*f* aligned in a string 57*f* of aligned collated clip assemblies. The string 57*f* of aligned collated clip assemblies 18*f* may be made of any number of clip assemblies 18*f* connected together using connectors 39. In each of the aligned collated clip assemblies 18*f*, connectors 39, made from the material of the second pieces 22*f* of clip assemblies 18*f*, extend between the second pieces 22*f* of adjacent clip assemblies 18*f*. Connectors 39 may be broken where desired in a clipping tool.

Figure 39:
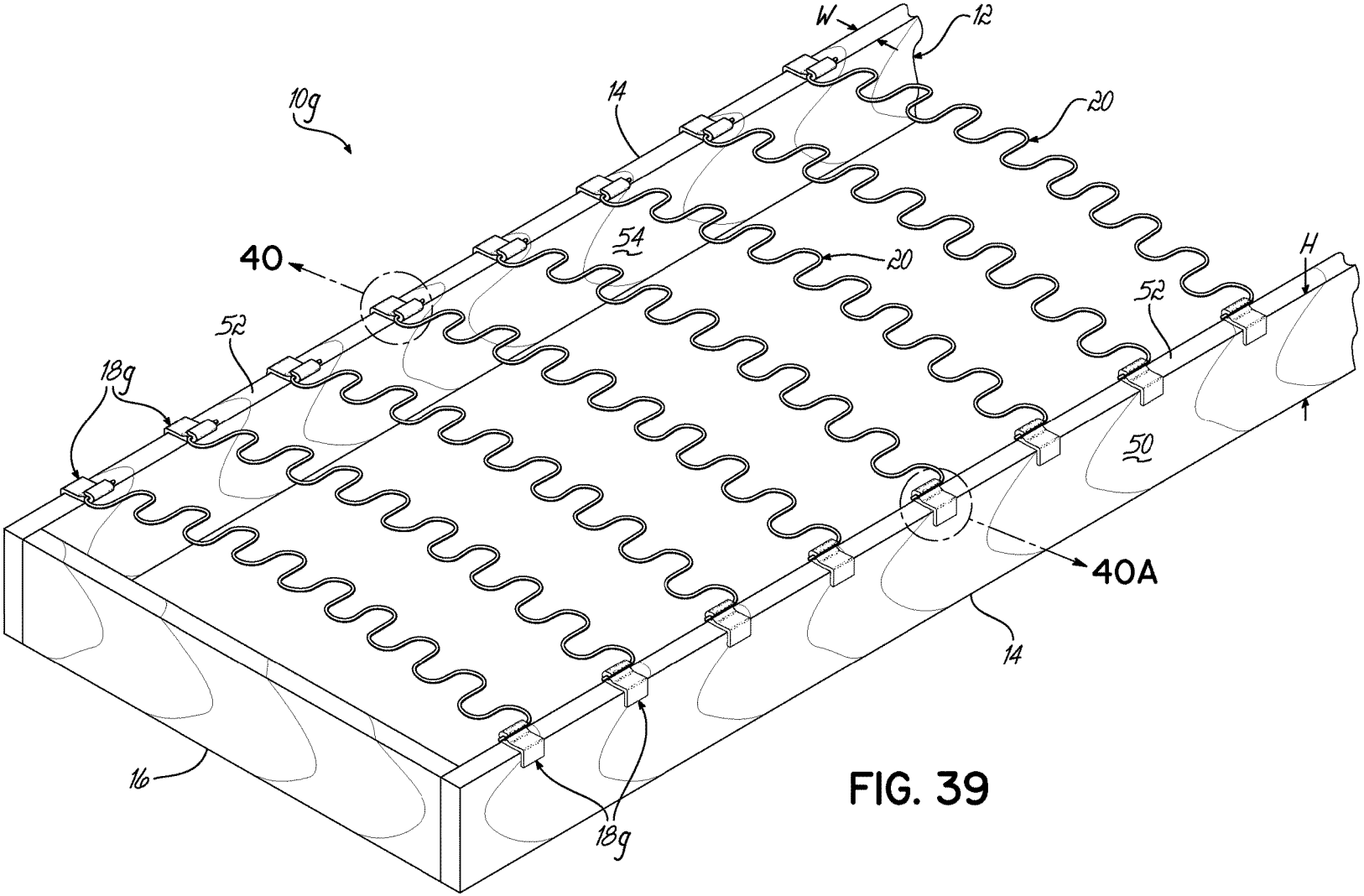
FIG. 39 is a perspective view of a furniture frame and sinuous springs extending from one side to the other side of the frame, clip assemblies in accordance with another embodiment being secured to the frame sides.

FIG. 39 illustrates a portion of a piece of furniture 10*g* comprising the same rectangular frame 12 illustrated in FIGS. 1 and 34. As shown in FIG. 39, furniture piece 10*g* further comprises a plurality of clip assemblies 18*g* secured to the side walls 14 of the frame 12 in a spaced manner for securing and retaining a plurality of sinuous springs 20. Clip assemblies 18*g*, secured to opposed side walls 14, are aligned to receive and retain end portions 21 of sinuous springs 20 in desired positions and under desired amounts of tension, as shown in FIG. 39. Commonly, such sinuous springs 20 are arched or bowed upwardly to provide resiliency to the furniture piece 10*g*.

Figure 40A:
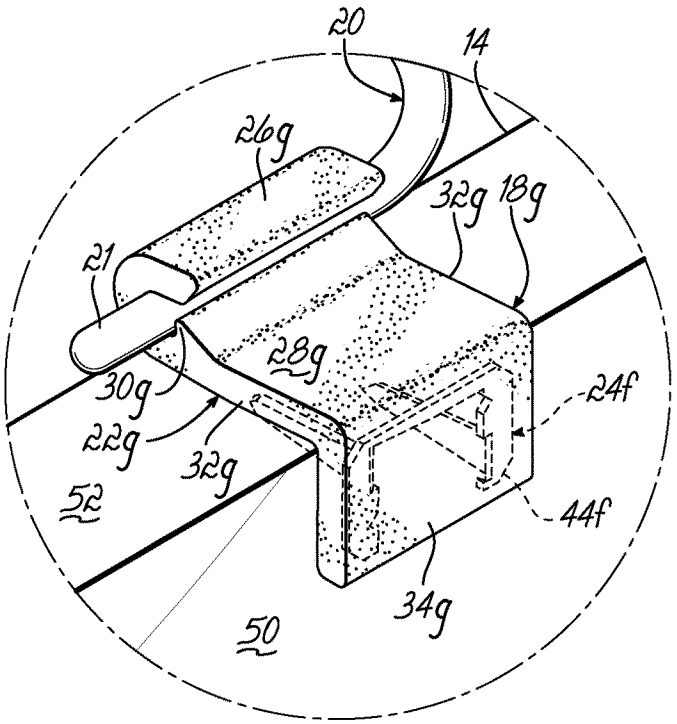
FIG. 40A is an enlarged view of the encircled area 40A of FIG. 39.
Figure 40:
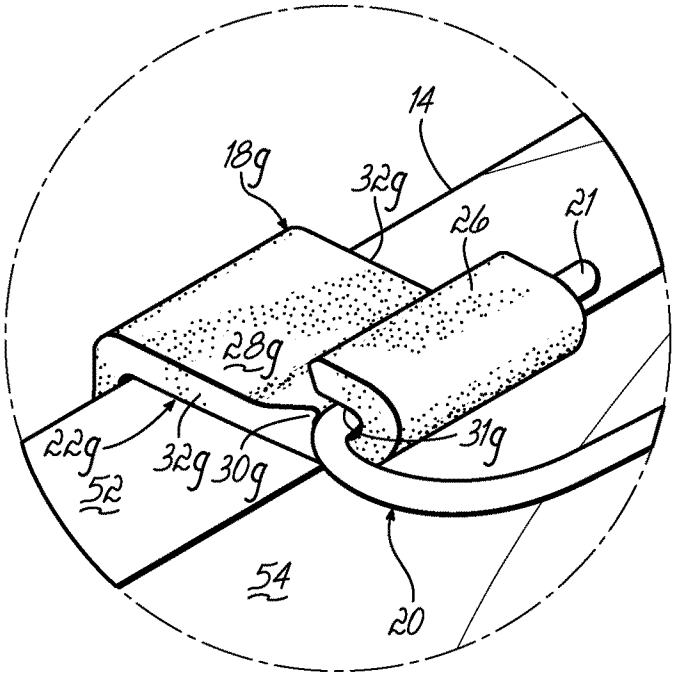
FIG. 40 is an enlarged view of the encircled area 40 of FIG. 39.

FIGS. 40 and 40A each show one of the clip assemblies 18*g* secured to one of the side walls 14 of frame 12. As best shown in FIG. 40A, each clip assembly 18*g* has a first piece 22*g* identical to the first piece 22*f* of clip assembly 18*f* without the grooves 36*f*. Each clip assembly 18*g* has a second metal piece 24*f* identical to the second metal piece 24*f* of clip assembly 18*f*. The pieces 22*g*, 24*f* are molded together into a unitary member and secured to one of the side walls 14 of the generally rectangular furniture frame 12.

As best shown in FIG. 40A, the first piece 22*g* of clip assembly 18*g* comprises a U-shaped hook portion 26*g* adapted to receive and retain an end portion 21 of one of the sinuous springs 20. The first piece 22*g* further comprises a generally planar body portion 28*g* which includes a ledge 30*g* extending from one side edge 32*g* to the opposed side edge 32*g* of the body portion 28*g* of the first piece 22*g* of the clip assembly 18*g*. When the end portion 21 of one of the sinuous springs 20 is inserted into the U-shaped hook portion 26*g*, the ledge 30*g* of the body portion 28*g* holds or retains the end portion 21 of the sinuous spring 20 in a receptacle 31*g*, illustrated in FIG. 40. The first piece 22*g* of clip assembly 18*g* further comprises a generally planar flange portion 34*g* extending outwardly from the end of the body portion 28*g* opposite the U-shaped hook portion 26*g* in a direction generally orthogonal or perpendicular to the body portion 28*g*. As best shown in FIG. 40A, the generally planar body portion 44*f* of the second piece 24*f* of clip assembly 18*g* is encased by or surrounded by the flange portion 34*g* of the first piece 22*g* of clip assembly 18*g* during a molding process. Rather than being secured together with connectors, these clip assemblies 18*g* may be stored and transported in a package 60 as shown in FIG. 9 or any other like container or package.

Figure 41:
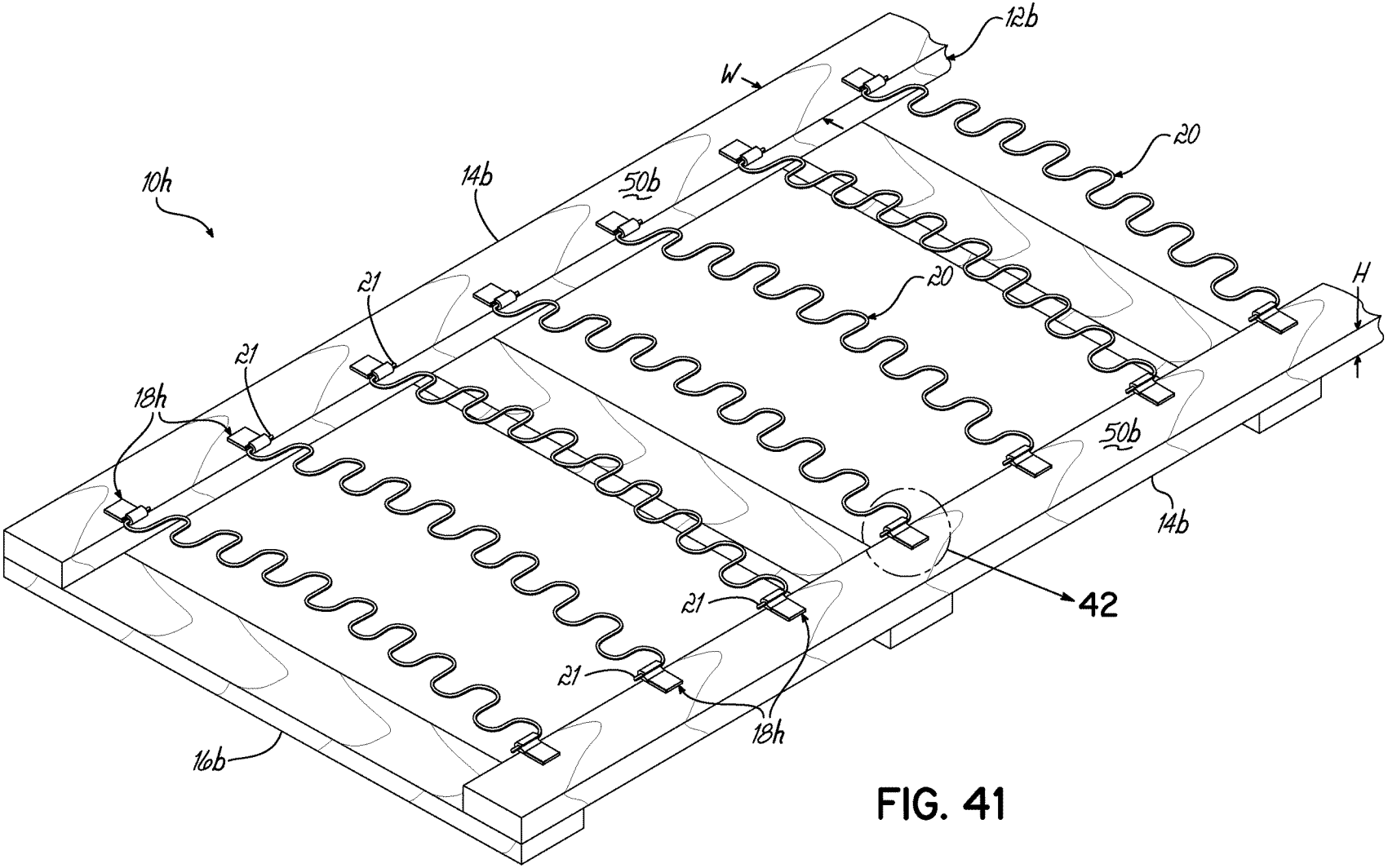
FIG. 41 is a perspective view of a frame and sinuous springs extending from one side to the other side of the frame, clip assemblies in accordance with another embodiment being secured to the frame sides.

FIG. 41 illustrates a portion of a piece of furniture 10*h* comprising a rectangular frame 12*b* comprising two side walls 14*b* and two end walls 16*b* (only one being shown in FIG. 41). The frame 12*b* is most commonly made of wood, but may be made of other suitable materials. Frame 12*b* is identical to the frame 12*b* shown in FIG. 10.

As shown in FIG. 41, furniture piece 10*h* further comprises a plurality of clip assemblies 18*h* secured to the side walls 14*b* of the frame 12*b* in a spaced manner for securing and retaining a plurality of sinuous springs 20. Clip assemblies 18*h*, secured to opposed side walls 14*b*, are aligned to receive and retain end portions 21 of sinuous springs 20 in desired positions and under desired amounts of tension, as shown in FIG. 41. Commonly, such sinuous springs 20 are arched or bowed upwardly to provide resiliency to the furniture piece 10*h*.

Figure 42A:
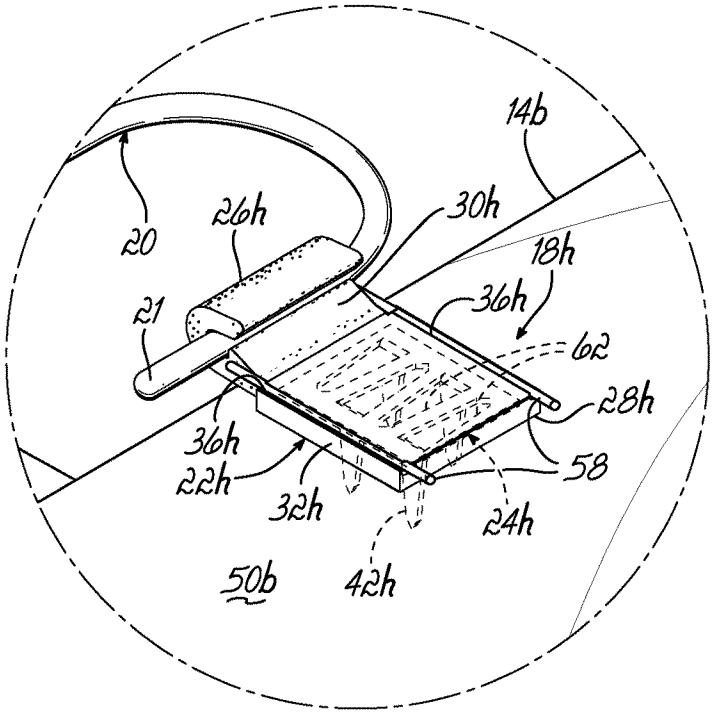
FIG. 42A is an enlarged view, similar to FIG. 42, of the clip assembly of FIG. 42 showing pieces of connector secured to the clip assembly.
Figure 42:
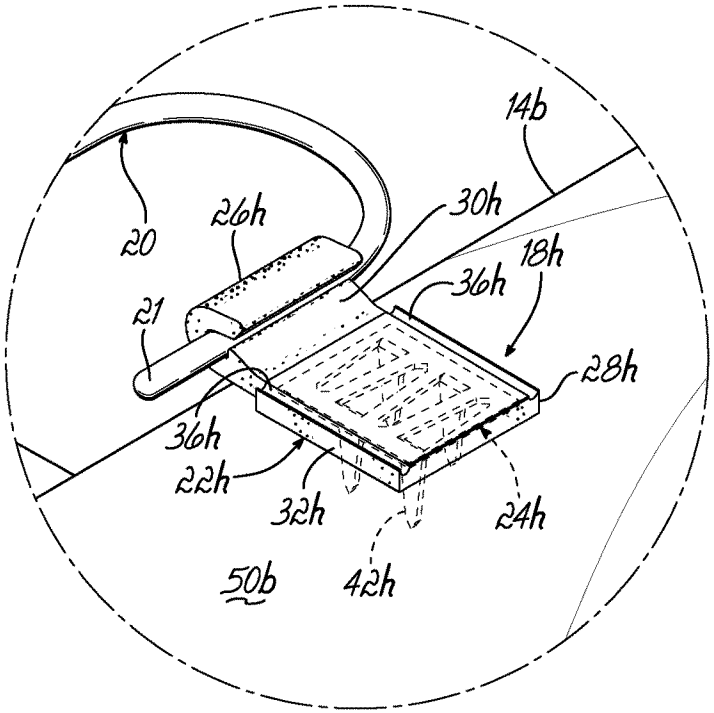
FIG. 42 is an enlarged view of the encircled area 42 of FIG. 41.

FIGS. 42 and 42A each show one of the clip assemblies 18*h* secured to one of the side walls 14*b* of frame 12*b*. As best shown in FIG. 42A, each clip assembly 18*h* comprises a first non-metallic piece 22*h*, usually made of plastic, and a second metal piece 24*h* molded together into a unitary member. The pieces 22*h*, 24*h* are joined together and secured to one of the side walls 14*b* of the generally rectangular furniture frame 12*b*.

As best shown in FIGS. 42-45, the first piece 22*h* of clip assembly 18*h* comprises a U-shaped hook portion 26*h* adapted to receive and retain an end portion 21 of one of the sinuous springs 20. The first piece 22*h* of clip assembly 18*h* further comprises a generally planar body portion 28*h* which includes a ledge 30*h* extending from one side edge 32*h* to the opposed side edge 32*h* of the body portion 28*h* of the first piece 22*h* of the clip assembly 18*h*. When the end portion 21 of one of the sinuous springs 20 is inserted into the U-shaped hook portion 26*h*, the ledge 30*h* of the body portion 28*h* holds or retains the end portion 21 of the sinuous spring 20 in a receptacle 31*h*, illustrated in FIG. 45. As best shown in FIG. 42, the body portion 28*h* of the first piece 22*h* of clip assembly 18*h* has a pair of spaced grooves 36*h* along the outer periphery of the body portion 16*h*, each of the grooves 36*h* being adapted to receive a non-metallic connector 38.

Figure 43:
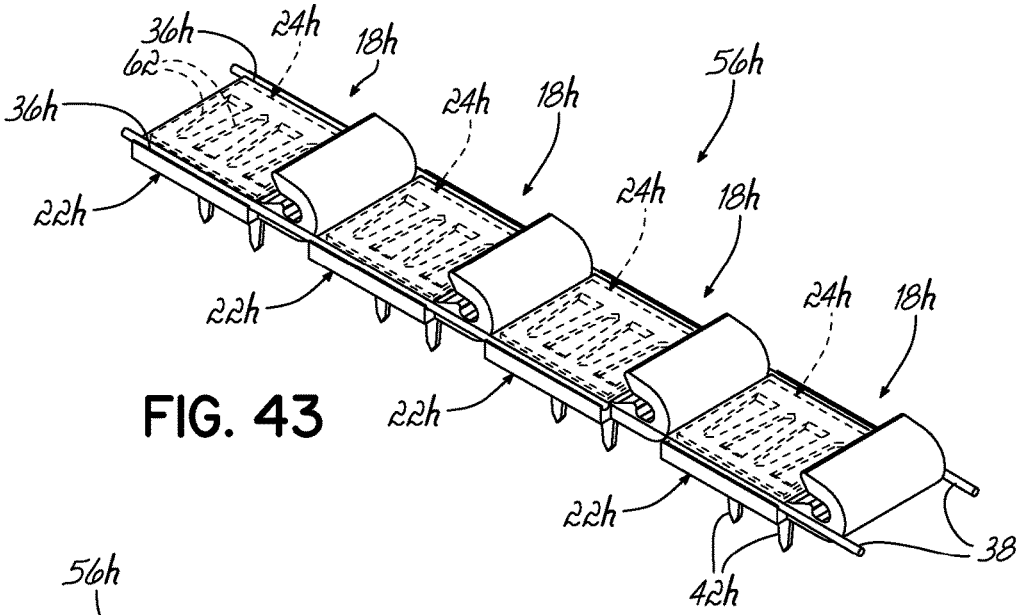
FIG. 43 is a perspective view of a portion of a collated string of clip assemblies of FIG. 41.
Figure 44:
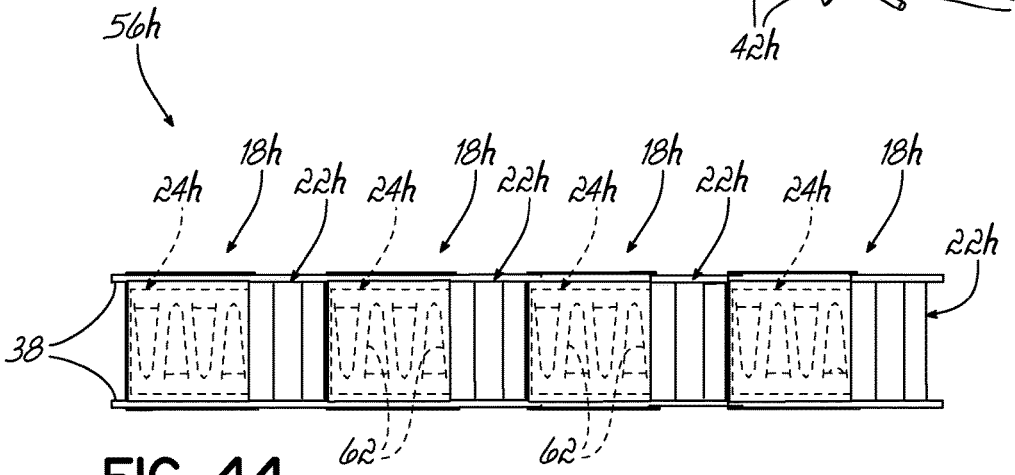
FIG. 44 is a top plan view of the portion of the collated string of clip assemblies of FIG. 43.
Figure 45:
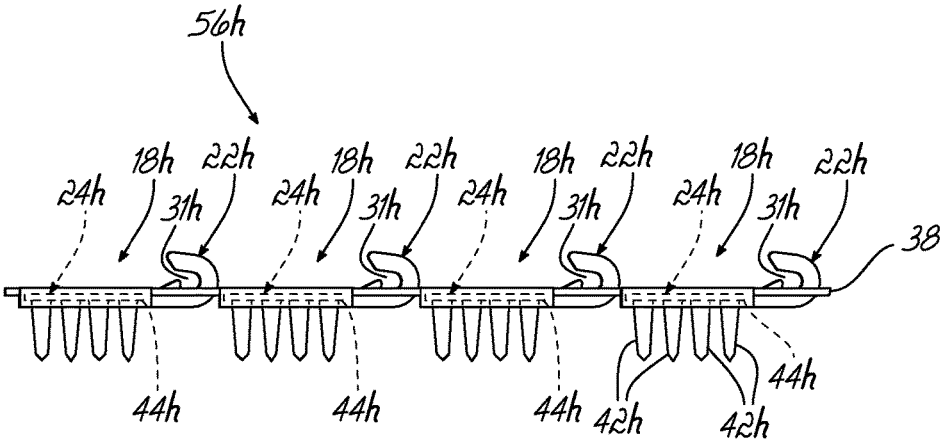
FIG. 45 is a side elevational view of the portion of the collated string of clip assemblies of FIG. 43.

Two connectors 38 connect multiple clip assemblies 18*h* together, as shown in FIGS. 43-45.

As best shown in FIG. 45, the second piece 24*h* of clip assembly 18*h* has four tacks 42*h* extending downwardly from a generally planar body portion 44*h* of the second metal piece 24*h* of clip assembly 18*h*. More particularly, each of the tacks 42*h* is formed from material from the body portion 44*h* of the second piece 24*h* of clip assembly 18*h* using a punch press. As best shown in FIGS. 42-44, tacks 24*h* initially lie in the plane of the body portion 44*h* and are bent downwardly out of the plane, thereby leaving four openings 62 in the body portion 44*h* of the second piece 24*h* of clip assembly 18*h*. The tacks 42*h* of the second piece 24*h* of clip assembly 18*h* are located and sized to pass through the first piece 22*h* of clip assembly 18*h*. Each of the tacks 42*h* of the second piece 24*h* of clip assembly 18*h* is generally planar, lacking the crease and serrations of the tacks 42*c* of the second piece 24*c* of clip assembly 18*c*, shown in FIG. 15A. However, each of the tacks 42*h* may have a crease therein so the tack 42*h* has a non-planar cross-section. Although not shown, the cross-section of each tack 42*h* may have a generally "V-shape", as shown in FIGS. 6 and 6B. Although not shown, each of the tacks 42*h* of the second piece 24*h* of clip assembly 18*h*, creased or not, may have a plurality of vertically spaced serrations or indentations like the serrations or indentations 48 shown in tacks 42 in FIGS. 6, 6B and 8 to improve the holding strength of the clip assembly 18*h* to the furniture frame 12*b*.

As best illustrated in FIGS. 41, 42 and 42A, the tacks 42*h* of the second piece 24*h* of clip assembly 18*h* are secured inside one of the side walls 14*b* of furniture frame 12*b* with a clipping tool (not shown). When secured in place, the body portion 28*h* of the first piece 22*h* of clip assembly 18*h* contacts or abuts an upper side surface 50*b* of one of the side walls 14*b* of furniture frame 12*b*. As best shown in FIGS. 42 and 42A, the U-shaped hook portion 26*h* of the first piece 22*h* of clip assembly 18*h* is located generally towards the interior of the rectangular frame 12*b*.

FIG. 43 shows four clip assemblies 18*h* aligned in a similar orientation and having the body portion 28*h* of the first piece 22*h* of a clip assembly 18*h* contacting or proximate the U-shaped hook portion 26*h* of the first piece 22*h* of an adjacent clip assembly 18*h*. When the clip assemblies 18*h* are juxtaposed in such a manner, the grooves 36*h* (see FIG. 42) of each clip assembly 18*h* are co-linearly aligned to permit a flexible connector 38 to be inserted into each of the aligned grooves 36*h* and extend the length of the aligned clip assemblies 18*h*. As best shown in FIGS. 43-45, each flexible connector 38 is inside a plurality of aligned grooves 36*h* of multiple clip assemblies 18*h*.

Although FIGS. 43-45 show four clip assemblies 18*h* aligned in a string 56*h* of aligned collated clip assemblies 18*h*, the string 56*h* of aligned collated clip assemblies 18*h* may be made of any number of clip assemblies 18*h* connected together.

The connectors 38 used to interconnect adjacent aligned clip assemblies 18*h* into a string 56*h* are preferably fabricated from a plastic material, such as a low density polyethylene or polyester plastic. The connectors 38 provide flexibility in the collated string 56*h* of clip assemblies 18*h*, which is needed when the string 56*h* is bent and rolled into a spool for insertion into a clipping tool. The connectors 38 have the required tensile strength to withstand pulling and twisting forces without breaking. Also, when a last clip assembly is cut off from the string 56*h*, there are no sharp or jagged barbs left over to injure workers or tear fabric covering the clipped wires.

When used in a clipping tool, the connectors 38 may be broken between adjacent clip assemblies 18*h* in the collated string 56*h* of clip assemblies 18*h*, leaving portions 58 of the connectors 38 with the clip assembly 18*h* secured to the frame 12*b*. FIG. 42A illustrates one such clip assembly 18*h*, each clip assembly 18*h* having portions 58 of the connectors 38 still with the clip assembly 18*h* when the clip assembly 18*h* is secured to one of the side walls 14*b* of frame 12*b*.

Figure 43A:
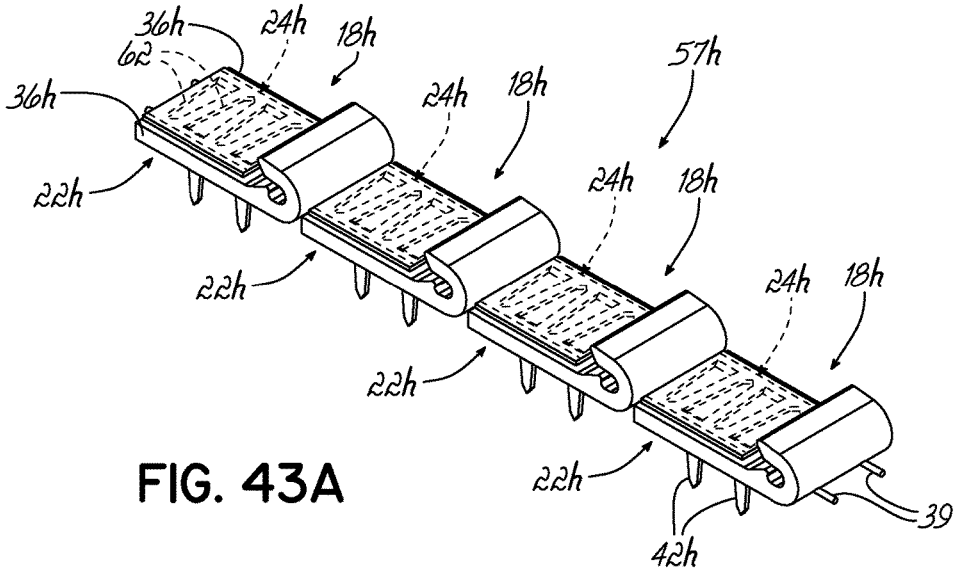
FIG. 43A is a perspective view of a portion of another collated string of clip assemblies.

FIG. 43A illustrates four clip assemblies 18*h* aligned in a string 57*h* of aligned collated clip assemblies. The string 57*h* of aligned collated clip assemblies 18*h* may be made of any number of clip assemblies 18*h* connected together using connectors 39. In each of the aligned collated clip assemblies 18*h*, connectors 39, made from the material of the second pieces 22 of clip assemblies 18*h*, extend between the second pieces 22*h* of adjacent clip assemblies 18*h*. Connectors 39 may be broken where desired in a clipping tool. Instead of connectors 38, connectors 39 may be used in any embodiment shown or described herein.

Figure 46A:
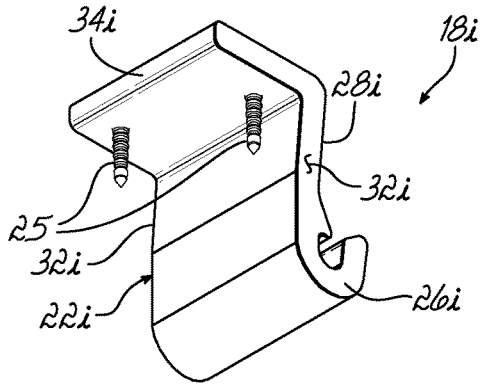
FIG. 46A is a bottom perspective view of a portion of another clip assembly.
Figure 46B:
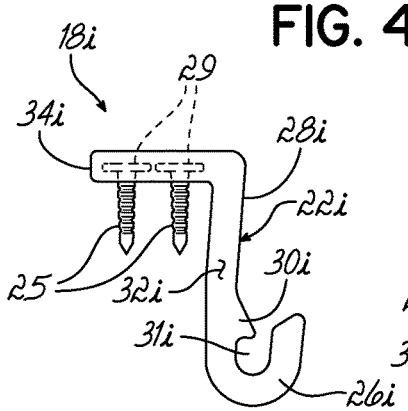
FIG. 46B is a side elevational view of the clip assembly of FIG. 46A.

FIGS. 46A-46E shows another variation of clip assembly 18*i*. As best shown in FIG. 46A, each clip assembly 18*i* has a first piece 22*i* identical to the first piece 22*g* of clip assembly 18*g* without the grooves. Each clip assembly 18*i* has a pair of fasteners 25. Although the fasteners 25 are illustrated as being threaded members, each fastener 25 may be unthreaded like the tacks 42*b* shown in FIG. 15, for example. The pieces 22*i*, 25 are molded together into a unitary member and secured to one of the side walls 14 of the generally rectangular furniture frame 12.

Figure 46C:
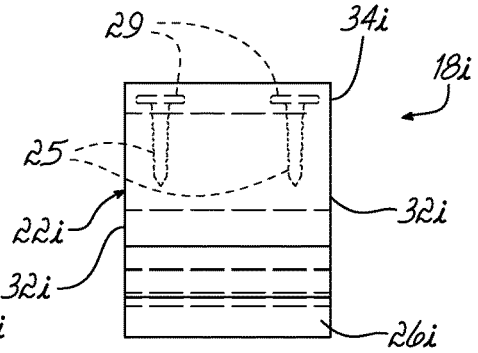
FIG. 46C is a front view of the clip assembly of FIG. 46A.
Figure 46D:
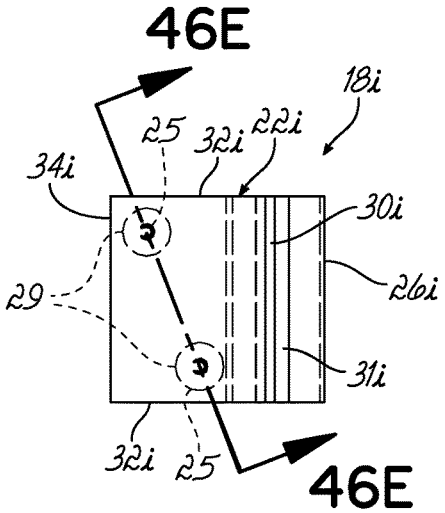
FIG. 46D is a top view of the clip assembly of FIG. 46A.
Figure 46E:
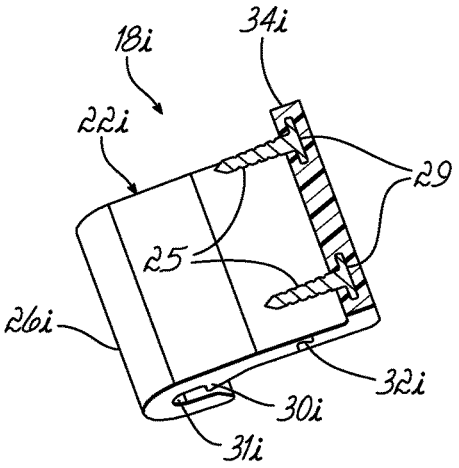
FIG. 46E is a cross sectional view of the clip assembly of FIG. 46A taken along the line 46E-46E of FIG. 46D.

As best shown in FIG. 46A, the first piece 22*i* of clip assembly 18*i* comprises a U-shaped hook portion 26*i* adapted to receive and retain an end portion 21 of one of the sinuous springs 20. The first piece 22*i* further comprises a generally planar body portion 28*i* which includes a ledge 30*i* extending from one side edge 32*i* to the opposed side edge 32*i* of the body portion 28*i* of the first piece 22*i* of the clip assembly 18*i*. When the end portion 21 of one of the sinuous springs 20 is inserted into the U-shaped hook portion 26*i*, the ledge 30*i* of the body portion 28*i* holds or retains the end portion 21 of the sinuous spring 20 in a receptacle 31*i*, illustrated in FIG. 46A. The first piece 22*i* of clip assembly 18*i* further comprises a generally planar flange portion 34*i* extending outwardly from the end of the body portion 28*i* opposite the U-shaped hook portion 26*i* in a direction generally orthogonal or perpendicular to the body portion 28*i*. As best shown in FIG. 46C, the heads 29 of the fasteners 25 of clip assembly 18*i* are encased by or surrounded by the flange portion 34*i* of the first piece 22*i* of clip assembly 18*i* during a molding process. Rather than being secured together with connectors, these clip assemblies 18*i* may be stored and transported in a package 60, as shown in FIG. 9 or any other like container or package.

Figure 47A:
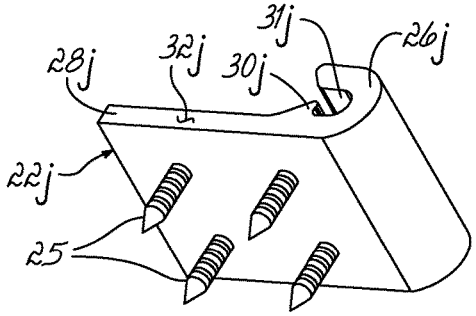
FIG. 47A is a bottom perspective view of a portion of another clip assembly.
Figure 47B:
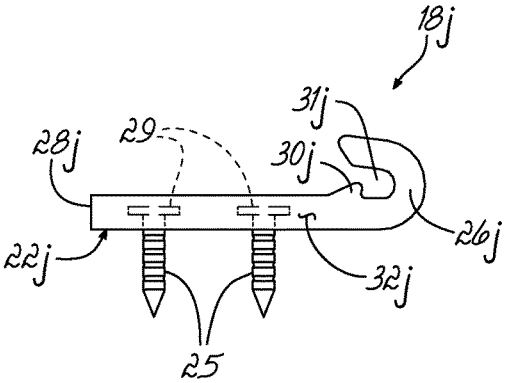
FIG. 47B is a side elevational view of the clip assembly of FIG. 47A.
Figure 47C:
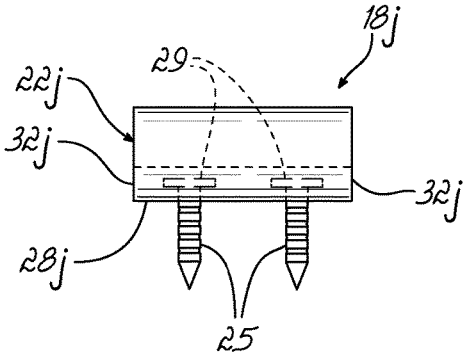
FIG. 47C is a front view of the clip assembly of FIG. 47A.

FIGS. 47A-47C shows another variation of clip assembly 18*j*. As best shown in FIG. 47A, each clip assembly 18*j* has a first piece 22*j* identical to the first piece 22*h* of clip assembly 18*h* without the grooves. Each clip assembly 18*j* has four fasteners 25. Although the fasteners 25 are illustrated as being threaded members, each fastener 25 may be unthreaded like the tacks 42*b* shown in FIG. 15, for example. The pieces 22*j*, 25 are molded together into a unitary member and secured to one of the side walls 14 of the generally rectangular furniture frame 12.

As best shown in FIG. 47A, the first piece 22*j* of clip assembly 18*j* comprises a U-shaped hook portion 26*j* adapted to receive and retain an end portion 21 of one of the sinuous springs 20. The first piece 22*j* further comprises a generally planar body portion 28*j* which includes a ledge 30*j* extending from one side edge 32*j* to the opposed side edge 32*j* of the body portion 28*j* of the first piece 22*j* of the clip assembly 18*j*. When the end portion 21 of one of the sinuous springs 20 is inserted into the U-shaped hook portion 26*j*, the ledge 30*j* of the body portion 28*j* holds or retains the end portion 21 of the sinuous spring 20 in a receptacle 31*j*, illustrated in FIG. 47A. As best shown in FIG. 47C, the heads 29 of the fasteners 25 of clip assembly 18*j* are encased by or surrounded by the body portion 28*j* of the first piece 22*j* of clip assembly 18*j* during a molding process. Rather than being secured together with connectors, these clip assemblies 18*j* may be stored and transported in a package 60, as shown in FIG. 9 or any other like container or package.

Although the tacks are shown having a certain cross-sectional configuration, they may be other sizes or shapes. Similarly, the openings in the non-metallic pieces of the clip assemblies may be any desired shapes or sizes. Although we have described several embodiments of the invention, we do not intend to be limited except by the scope of the following claims.

We claim:

1. A clip assembly for securing an end portion of a sinuous spring to a wooden rail, said clip assembly comprising:

a metal fastener including four tacks extending downwardly from a generally planar portion of the metal fastener; and a plastic piece comprising a generally planar body portion, a U-shaped hook portion extending outwardly from one end of the body portion, the hook portion being adapted to receive and retain the end portion of the sinuous spring, wherein the metal fastener and plastic piece are molded together into a unitary member, the generally planar portion of the metal fastener being encased by the generally planar body portion of the plastic piece, the tacks of the metal fastener extending through the generally planar body portion of the plastic piece and being adapted to extend into the wooden rail.

2. The clip assembly of claim 1 wherein the metal fastener is a unitary member, the tacks of the metal fastener being formed from the material of the metal fastener and extending outwardly from the generally planar portion of the metal fastener.

3. The clip assembly of claim 1 wherein at least one of the tacks of the metal fastener is serrated.

4. The clip assembly of claim 1 wherein each of the tacks of the metal fastener is serrated.

5. The clip assembly of claim 1 wherein at least one of the tacks of the metal fastener is creased.

6. The clip assembly of claim 1 wherein each of the tacks of the metal fastener is creased.

7. The clip assembly of claim 1 wherein the generally planar body portion of the plastic piece has spaced grooves therein adapted to receive flexible connectors to join multiple clip assemblies together.

8. The clip assembly of claim 1 wherein a portion of the metal fastener has openings created by forming the tacks.

9. The clip assembly of claim 1 wherein the generally planar body portion of the plastic piece has a ledge extending from one side edge to the opposed side edge of the plastic piece.

10. A clip assembly for securing an end portion of a sinuous spring to a wooden rail, said clip assembly comprising:

a metal fastener including four tacks extending outwardly from a planar portion of the metal fastener; and a non-metallic piece comprising a generally planar body portion, a U-shaped hook portion extending outwardly from one end of the body portion, wherein the generally planar body portion of the non-metallic piece has a ledge extending from one side edge to the opposed side edge of the non-metallic piece, the hook portion and ledge being adapted to receive and retain the end portion of the sinuous spring, wherein the metal fastener and non-metallic piece are molded together into a unitary member, the generally planar portion of the metal fastener being encased by the generally planar portion of the non-metallic piece, the tacks of the metal fastener extending through the non-metallic piece and being adapted to be embedded into the wooden rail.

11. The clip assembly of claim 10 wherein the non-metallic piece has spaced grooves therein adapted to receive flexible connectors to join multiple clip assemblies together.

12. The clip assembly of claim 10 wherein the metal fastener is a unitary member, the tacks of the metal fastener being formed from the material of the metal fastener and extending outwardly from the remainder of the metal fastener.

13. The clip assembly of claim 10 wherein at least one of the tacks of the metal fastener is serrated.

14. The clip assembly of claim 10 wherein each of the tacks of the metal fastener is serrated.

15. The clip assembly of claim 10 wherein at least one of the tacks of the metal fastener is creased.

16. The clip assembly of claim 10 wherein each of the tacks of the metal fastener is creased.

17. A clip assembly for securing an end portion of a sinuous spring to a wooden rail, said clip assembly comprising:

a first non-metallic piece comprising a generally planar body portion, a U-shaped hook portion extending outwardly from one end of the body portion, the generally planar body portion of the first non-metallic piece having a ledge extending from one side edge to the opposed side edge of the plastic piece, the hook portion and ledge being adapted to receive and retain the end portion of the sinuous spring; and a second metal piece having four projections extending outwardly from a planar portion of the metal piece through the first piece, the projections being adapted to be secured into a wooden rail, wherein the first and second pieces are molded together into a unitary member, the generally planar portion of the second metal piece being encased by the generally planar portion of the first non-metallic piece, the tacks of the second metal piece extending through the generally planar body portion of the first non-metallic piece.

18. The clip assembly of claim 17 wherein the first non-metallic piece has spaced grooves therein adapted to receive flexible connectors to join multiple clip assemblies together.

19. The clip assembly of claim 17 wherein the second piece is a unitary member, the tacks of the metal fastener being formed from the material of the second piece and extending outwardly from the remainder of the second piece.

20. The clip assembly of claim 17 wherein at least one of the tacks of the second piece is serrated.

21. The clip assembly of claim 17 wherein at least one of the tacks of the second piece is creased.

* * * * *